US010092998B2

(12) United States Patent
Qian et al.

(10) Patent No.: US 10,092,998 B2
(45) **Date of Patent: *Oct. 9, 2018**

(54) METHOD OF MAKING COMPOSITE POLISHING LAYER FOR CHEMICAL MECHANICAL POLISHING PAD

(71) Applicants: Rohm and Haas Electronic Materials CMP Holdings, Inc., Newark, DE (US); Dow Global Technologies LLC, Midland, MI (US)

(72) Inventors: Bainian Qian, Newark, DE (US); Teresa Brugarolas Brufau, Philadelphia, PA (US); Julia Kozhukh, Bear, DE (US); David Michael Veneziale, Hatfield, PA (US); Yuhua Tong, Hockessin, DE (US); Diego Lugo, Newark, DE (US); George C. Jacob, Newark, DE (US); Jeffrey B. Miller, West Chester, PA (US); Tony Quan Tran, Bear, DE (US); Marc R. Stack, Middletown, DE (US); Andrew Wank, Avondale, PA (US); Jeffrey James Hendron, Elkton, MD (US)

(73) Assignees: Rohm and Haas Electronic Materials CMP Holdings, Inc., Newark, DE (US); Dow Global Technologies LLC, Midland, MI (US)

( * ) Notice: Subject to any disclaimer, the term of this patent is extended or adjusted under 35 U.S.C. 154(b) by 102 days.

This patent is subject to a terminal disclaimer.

(21) Appl. No.: 15/163,184

(22) Filed: May 24, 2016

(65) Prior Publication Data

US 2016/0375554 A1 Dec. 29, 2016

Related U.S. Application Data

(63) Continuation-in-part of application No. 14/751,410, filed on Jun. 26, 2015.

(51) Int. Cl.
*B24D 18/00* (2006.01)
*B24D 11/00* (2006.01)
(Continued)

(52) U.S. Cl.
CPC ..... *B24D 18/0009* (2013.01); *B24B 37/044* (2013.01); *B24B 37/24* (2013.01); *B24B 53/017* (2013.01)

(58) Field of Classification Search
CPC ..... B24D 18/00; B24D 11/00; B24B 37/24; C08G 18/00; C08G 18/10
See application file for complete search history.

(56) References Cited

U.S. PATENT DOCUMENTS 3,677,681 A 7/1972 Zippel et al.
3,705,821 A 12/1972 Breer et al.
(Continued)

FOREIGN PATENT DOCUMENTS

JP 2001172732 12/2002

*Primary Examiner* — Pegah Parvini
(74) *Attorney, Agent, or Firm* — Thomas S. Deibert; Andrew Merriam; Blake T. Biederman

(57) ABSTRACT

A method of forming a chemical mechanical polishing pad composite polishing layer is provided, including: providing a first polishing layer component of a first continuous non-fugitive polymeric phase having a plurality of periodic recesses; discharging a combination toward the first polishing layer component at a velocity of 5 to 1,000 m/sec, filling the plurality of periodic recesses with the combination; allowing the combination to solidify in the plurality of periodic recesses forming a second non-fugitive polymeric phase giving a composite structure; and, deriving the chemical mechanical polishing pad composite polishing layer from the composite structure, wherein the chemical mechanical polishing pad composite polishing layer has a polishing surface on the polishing side of the first polishing
(Continued)

layer component; and wherein the polishing surface is adapted for polishing a substrate.

10 Claims, 15 Drawing Sheets

(51) Int. Cl.

| | |
|---|---|
| ***B24B 37/24*** | (2012.01) |
| ***B24B 37/04*** | (2012.01) |
| ***B24B 53/017*** | (2012.01) |

(56) References Cited

U.S. PATENT DOCUMENTS

| | | | | |
|---|---|---|---|---|
| 3,954,544 | A | 5/1976 | Hooker | |
| 4,053,283 | A | 10/1977 | Schneider et al. | |
| 4,144,295 | A | 3/1979 | Dever, Jr. | |
| 5,110,081 | A * | 5/1992 | Lang, Jr. | F16F 3/0873 248/635 |
| 5,163,584 | A | 11/1992 | Huber et al. | |
| 7,214,757 | B2 * | 5/2007 | Gloyer | C08G 18/10 528/60 |
| 7,670,517 | B2 | 3/2010 | Tadokoro et al. | |
| 8,314,029 | B2 | 11/2012 | Hirose et al. | |
| 9,457,449 | B1 | 10/2016 | Brugarolas Brufau et al. | |
| 9,539,694 | B1 | 1/2017 | Kozhukh et al. | |
| 2005/0171225 | A1 * | 8/2005 | Kulp | B24B 37/24 521/155 |
| 2006/0189269 | A1 * | 8/2006 | Roy | B24B 37/24 451/526 |
| 2007/0128372 | A1 | 6/2007 | Wirth et al. | |
| 2009/0094900 | A1 | 4/2009 | Swisher et al. | |
| 2016/0037552 | A1 | 2/2016 | Svedman et al. | |
| 2016/0375543 | A1 | 12/2016 | Qian et al. | |
| 2016/0375545 | A1 | 12/2016 | Qian et al. | |
| 2016/0375550 | A1 | 12/2016 | Tong et al. | |
| 2016/0375553 | A1 | 12/2016 | Veneziale et al. | |
| 2016/0375555 | A1 | 12/2016 | Veneziale et al. | |
| 2016/0379840 | A1 | 12/2016 | Qian et al. | |

* cited by examiner

METHOD OF MAKING COMPOSITE POLISHING LAYER FOR CHEMICAL MECHANICAL POLISHING PAD

This application is a continuation-in-part of U.S. Ser. No. 14/751,410, filed Jun. 26, 2015, now pending.

The present invention relates to a method of forming a chemical mechanical polishing pad composite polishing layer. More particularly, the present invention relates to a method of forming a chemical mechanical polishing pad composite polishing layer using an axial mixing device.

In the fabrication of integrated circuits and other electronic devices, multiple layers of conducting, semiconducting and dielectric materials are deposited onto and removed from a surface of a semiconductor wafer. Thin layers of conducting, semiconducting and dielectric materials may be deposited using a number of deposition techniques. Common deposition techniques in modern wafer processing include physical vapor deposition (PVD), also known as sputtering, chemical vapor deposition (CVD), plasma-enhanced chemical vapor deposition (PECVD) and electrochemical plating, among others. Common removal techniques include wet and dry isotropic and anisotropic etching, among others.

As layers of materials are sequentially deposited and removed, the uppermost surface of the wafer becomes non-planar. Because subsequent semiconductor processing (e.g., metallization) requires the wafer to have a flat surface, the wafer needs to be planarized. Planarization is useful for removing undesired surface topography and surface defects, such as rough surfaces, agglomerated materials, crystal lattice damage, scratches and contaminated layers or materials.

Chemical mechanical planarization, or chemical mechanical polishing (CMP), is a common technique used to planarize or polish work pieces such as semiconductor wafers. In conventional CMP, a wafer carrier, or polishing head, is mounted on a carrier assembly. The polishing head holds the wafer and positions the wafer in contact with a polishing layer of a polishing pad that is mounted on a table or platen within a CMP apparatus. The carrier assembly provides a controllable pressure between the wafer and polishing pad. Simultaneously, a polishing medium (e.g., slurry) is dispensed onto the polishing pad and is drawn into the gap between the wafer and polishing layer. To effect polishing, the polishing pad and wafer typically rotate relative to one another. As the polishing pad rotates beneath the wafer, the wafer sweeps out a typically annular polishing track, or polishing region, wherein the wafer's surface directly confronts the polishing layer. The wafer surface is polished and made planar by chemical and mechanical action of the polishing layer and polishing medium on the surface.

James et al. disclose the importance of grooving in the polishing surface of chemical mechanical polishing pads in U.S. Pat. No. 6,736,709. Specifically, James et al. teach that the "Groove Stiffness Quotient" ("GSQ") estimates the effects of grooving on pad stiffness and the "Groove Flow Quotient" ("GFQ") estimates the effects of grooving on (pad interface) fluid flow; and that there is a delicate balance between the GSQ and GFQ in selecting an ideal polishing surface for a given polishing process.

Notwithstanding, as wafer dimension continue to shrink the demands of the associated polishing processes are becoming evermore intense.

Accordingly, there is a continuing need for polishing layer designs that expand the operating performance range of chemical mechanical polishing pads and for methods of manufacturing the same.

The present invention provides a method of forming a chemical mechanical polishing pad composite polishing layer, comprising: providing a first polishing layer component of the chemical mechanical polishing pad composite polishing layer; wherein the first polishing layer component has a polishing side, a base surface, a plurality of periodic recesses and an average first component thickness, $T_{1\text{-}avg}$, measured normal to the polishing side from the base surface to the polishing side; wherein the first polishing layer component comprises a first continuous non-fugitive polymeric phase; wherein the plurality of periodic recesses have an average recess depth, $D_{avg}$, measured normal to the polishing side from the polishing side toward the base surface, wherein the average recess depth, $D_{avg}$, is less than the average first component thickness, $T_{1\text{-}avg}$; wherein the first continuous non-fugitive polymeric phase is a reaction product of a first continuous phase isocyanate-terminated urethane prepolymer having 8 to 12 wt % unreacted NCO groups and a first continuous phase curative; providing a poly side (P) liquid component, comprising at least one of a (P) side polyol, a (P) side polyamine and a (P) side alcohol amine; providing an iso side (I) liquid component, comprising at least one polyfunctional isocyanate; providing a pressurized gas; providing an axial mixing device having an internal cylindrical chamber; wherein the internal cylindrical chamber has a closed end, an open end, an axis of symmetry, at least one (P) side liquid feed port that opens into the internal cylindrical chamber, at least one (I) side liquid feed port that opens into the internal cylindrical chamber, and at least one tangential pressurized gas feed port that opens into the internal cylindrical chamber; wherein the closed end and the open end are perpendicular to the axis of symmetry; wherein the at least one (P) side liquid feed port and the at least one (I) side liquid feed port are arranged along a circumference of the internal cylindrical chamber proximate the closed end; wherein the at least one tangential pressurized gas feed port is arranged along the circumference of the internal cylindrical chamber downstream of the at least one (P) side liquid feed port and the at least one (I) side liquid feed port from the closed end; wherein the poly side (P) liquid component is introduced into the internal cylindrical chamber through the at least one (P) side liquid feed port at a (P) side charge pressure of 6,895 to 27,600 kPa; wherein the iso side (I) liquid component is introduced into the internal cylindrical chamber through the at least one (I) side liquid feed port at an (I) side charge pressure of 6,895 to 27,600 kPa; wherein a combined mass flow rate of the poly side (P) liquid component and the iso side (I) liquid component to the internal cylindrical chamber is 1 to 500 g/s, such as, preferably, from 2 to 40 g/s or, more preferably, 2 to 25 g/s; wherein the poly side (P) liquid component, the iso side (I) liquid component and the pressurized gas are intermixed within the internal cylindrical chamber to form a combination; wherein the pressurized gas is introduced into the internal cylindrical chamber through the at least one tangential pressurized gas feed port with a supply pressure of 150 to 1,500 kPa; wherein an inlet velocity into the internal cylindrical chamber of the pressurized gas is 50 to 600 m/s calculated based on ideal gas conditions at 20° C. and 1 atm pressure, or, preferably, 75 to 350 m/s; discharging the combination from the open end of the internal cylindrical chamber toward the polishing side of the first polishing layer component at a velocity of 5 to 1,000 m/sec, or, preferably, from 10 to 600 m/sec or, more preferably, from 15 to 450 m/sec, filling the plurality of periodic recesses with the combination; allowing the combination to solidify as a second polishing layer component in the plurality of periodic recesses to form a composite structure; wherein the second polishing layer component is a second non-fugitive polymeric phase; and, deriving the chemical mechanical polishing pad composite polishing layer from the composite structure, wherein the chemical mechanical polishing pad composite polishing layer has a polishing surface on the polishing side of the first polishing layer component; and wherein the polishing surface is adapted for polishing a substrate.

The present invention provides a method of forming a chemical mechanical polishing pad composite polishing layer, comprising: providing a first polishing layer component of the chemical mechanical polishing pad composite polishing layer; wherein the first polishing layer component has a polishing side, a base surface, a plurality of periodic recesses and an average first component thickness, $T_{1\text{-}avg}$, measured normal to the polishing side from the base surface to the polishing side; wherein the first polishing layer component comprises a first continuous non-fugitive polymeric phase; wherein the plurality of periodic recesses have an average recess depth, $D_{avg}$, measured normal to the polishing side from the polishing side toward the base surface, wherein the average recess depth, $D_{avg}$, is less than the average first component thickness, $T_{1\text{-}avg}$; wherein the first continuous non-fugitive polymeric phase is a reaction product of a first continuous phase isocyanate-terminated urethane prepolymer having 8 to 12 wt % unreacted NCO groups and a first continuous phase curative; providing a poly side (P) liquid component, comprising at least one of a (P) side polyol, a (P) side polyamine and a (P) side alcohol amine; providing an iso side (I) liquid component, comprising at least one polyfunctional isocyanate; providing a pressurized gas; providing an axial mixing device having an internal cylindrical chamber; wherein the internal cylindrical chamber has a closed end, an open end, an axis of symmetry, at least one (P) side liquid feed port that opens into the internal cylindrical chamber, at least one (I) side liquid feed port that opens into the internal cylindrical chamber, and at least one tangential pressurized gas feed port that opens into the internal cylindrical chamber; wherein the closed end and the open end are perpendicular to the axis of symmetry; wherein the at least one (P) side liquid feed port and the at least one (I) side liquid feed port are arranged along a circumference of the internal cylindrical chamber proximate the closed end; wherein the at least one tangential pressurized gas feed port is arranged along the circumference of the internal cylindrical chamber downstream of the at least one (P) side liquid feed port and the at least one (I) side liquid feed port from the closed end; wherein the poly side (P) liquid component is introduced into the internal cylindrical chamber through the at least one (P) side liquid feed port at a (P) side charge pressure of 6,895 to 27,600 kPa; wherein the iso side (I) liquid component is introduced into the internal cylindrical chamber through the at least one (I) side liquid feed port at an (I) side charge pressure of 6,895 to 27,600 kPa; wherein a combined mass flow rate of the poly side (P) liquid component and the iso side (I) liquid component to the internal cylindrical chamber is 1 to 500 g/s, such as, preferably, from 2 to 40 g/s or, more preferably, 2 to 25 g/s; wherein the poly side (P) liquid component, the iso side (I) liquid component and the pressurized gas are intermixed within the internal cylindrical chamber to form a combination; wherein the pressurized gas is introduced into the internal cylindrical chamber through the at least one tangential pressurized gas feed port with a supply pressure of 150 to 1,500 kPa; wherein an inlet velocity into the internal cylindrical chamber of the pressurized gas is 50 to 600 m/s, calculated based on ideal gas conditions at 20° C. and 1 atm pressure, or, preferably, 75 to 350 m/s; discharging the combination from the open end of the internal cylindrical chamber toward the polishing side of the first polishing layer component at a velocity of 5 to 1,000 m/sec, or, preferably, from 10 to 600 m/sec or, more preferably, from 15 to 450 m/sec, filling the plurality of periodic recesses with the combination; allowing the combination to solidify as a second polishing layer component in the plurality of periodic recesses to form a composite structure; wherein the second polishing layer component is a second non-fugitive polymeric phase; and, machining the composite structure to derive the chemical mechanical polishing pad composite polishing layer; wherein the chemical mechanical polishing pad composite polishing layer so derived has an average composite polishing layer thickness, $T_{P\text{-}avg}$, measured normal to the polishing surface from the base surface to the polishing surface; wherein the average first component thickness, $T_{1\text{-}avg}$, equals the average composite polishing layer thickness, $T_{P\text{-}avg}$; wherein the second non-fugitive polymeric phase occupying the plurality of periodic recesses has an average height, $H_{avg}$, measured normal to the polishing surface from the base surface toward the polishing surface; wherein an absolute value of a difference, $\Delta S$, between the average composite polishing layer thickness, $T_{P\text{-}avg}$, and the average height, $H_{avg}$, is $\leq 0.5$ μm; wherein the chemical mechanical polishing pad composite polishing layer has a polishing surface on the polishing side of the first polishing layer component; and wherein the polishing surface is adapted for polishing a substrate.

The present invention provides a method of forming a chemical mechanical polishing pad composite polishing layer, comprising: providing a mold having a floor and a surrounding wall, wherein the floor and the surrounding wall define a mold cavity; providing a first continuous phase isocyanate-terminated urethane prepolymer having 8 to 12 wt % unreacted NCO groups, a first continuous phase curative and, optionally, a plurality of hollow core polymeric materials; mixing the first continuous phase isocyanate-terminated urethane prepolymer, the first continuous phase curative and the optional plurality of hollow core polymeric materials to form a mixture; pouring the mixture into the mold cavity; allowing the mixture to solidify into a cake of a first continuous non-fugitive polymeric phase; deriving a sheet from the cake; forming a plurality of periodic recesses in the sheet to provide a first polishing layer component of the chemical mechanical polishing pad composite polishing layer; wherein the first polishing layer component has a polishing side, a base surface, a plurality of periodic recesses and an average first component thickness, $T_{1\text{-}avg}$, measured normal to the polishing side from the base surface to the polishing side; wherein the plurality of periodic recesses have an average recess depth, $D_{avg}$, measured normal to the polishing side from the polishing side toward the base surface, wherein the average recess depth, $D_{avg}$, is less than the average first component thickness, $T_{1\text{-}avg}$; providing a poly side (P) liquid component, comprising at least one of a (P) side polyol, a (P) side polyamine and a (P) side alcohol amine; providing an iso side (I) liquid component, comprising at least one polyfunctional isocyanate; providing a pressurized gas; providing an axial mixing device having an internal cylindrical chamber; wherein the internal cylindrical chamber has a closed end, an open end, an axis of symmetry, at least one (P) side liquid feed port that opens into the internal cylindrical chamber, at least one (I) side liquid feed port that opens into the internal cylindrical chamber, and at least one tangential pressurized gas feed port that opens into the internal cylindrical chamber; wherein the closed end and the open end are perpendicular to the axis of symmetry; wherein the at least one (P) side liquid feed port and the at least one (I) side liquid feed port are arranged along a circumference of the internal cylindrical chamber proximate the closed end; wherein the at least one tangential pressurized gas feed port is arranged along the circumference of the internal cylindrical chamber downstream of the at least one (P) side liquid feed port and the at least one (I) side liquid feed port from the closed end; wherein the poly side (P) liquid component is introduced into the internal cylindrical chamber through the at least one (P) side liquid feed port at a (P) side charge pressure of 6,895 to 27,600 kPa; wherein the iso side (I) liquid component is introduced into the internal cylindrical chamber through the at least one (I) side liquid feed port at an (I) side charge pressure of 6,895 to 27,600 kPa; wherein a combined mass flow rate of the poly side (P) liquid component and the iso side (I) liquid component to the internal cylindrical chamber is 1 to 500 g/s, such as, preferably, from 2 to 40 g/s or, more preferably, 2 to 25 g/s; wherein the poly side (P) liquid component, the iso side (I) liquid component and the pressurized gas are intermixed within the internal cylindrical chamber to form a combination; wherein the pressurized gas is introduced into the internal cylindrical chamber through the at least one tangential pressurized gas feed port with a supply pressure of 150 to 1,500 kPa; wherein an inlet velocity into the internal cylindrical chamber of the pressurized gas is 50 to 600 m/s calculated based on ideal gas conditions at 20° C. and 1 atm pressure, or, preferably, 75 to 350 m/s; discharging the combination from the open end of the internal cylindrical chamber toward the polishing side of the first polishing layer component at a velocity of 5 to 1,000 m/sec, or, preferably, from 10 to 600 m/sec or, more preferably, from 15 to 450 m/sec, filling the plurality of periodic recesses with the combination; allowing the combination to solidify as a second polishing layer component in the plurality of periodic recesses to form a composite structure; wherein the second polishing layer component is a second non-fugitive polymeric phase; and, deriving the chemical mechanical polishing pad composite polishing layer from the composite structure, wherein the chemical mechanical polishing pad composite polishing layer has a polishing surface on the polishing side of the first polishing layer component; and wherein the polishing surface is adapted for polishing a substrate.

DETAILED DESCRIPTION

Historically, the GSQ and GFQ values for a polishing surface of a given polishing layer provided a workable range within which to design effective polishing layers. Surprisingly, the present invention provides a method of making composite polishing layers the provide a means for breaking the mold of heretofore established GSQ and GFQ parameters for polishing layers by decoupling the polishing layer stiffness and slurry distribution performance of polishing layer designs; thereby expanding the range of polishing layer designs to heretofore unobtainable balances of polishing performance properties.

The term "non-fugitive" as used herein and in the appended claims in reference to a polymeric phase means that the polymeric phase (e.g., the second non-fugitive polymeric phase) does not melt, dissolve, disintegrate or otherwise deplete selectively relative to another polymer phase (e.g., the first continuous non-fugitive polymeric phase) present in the composite polishing layer.

Figure 1:
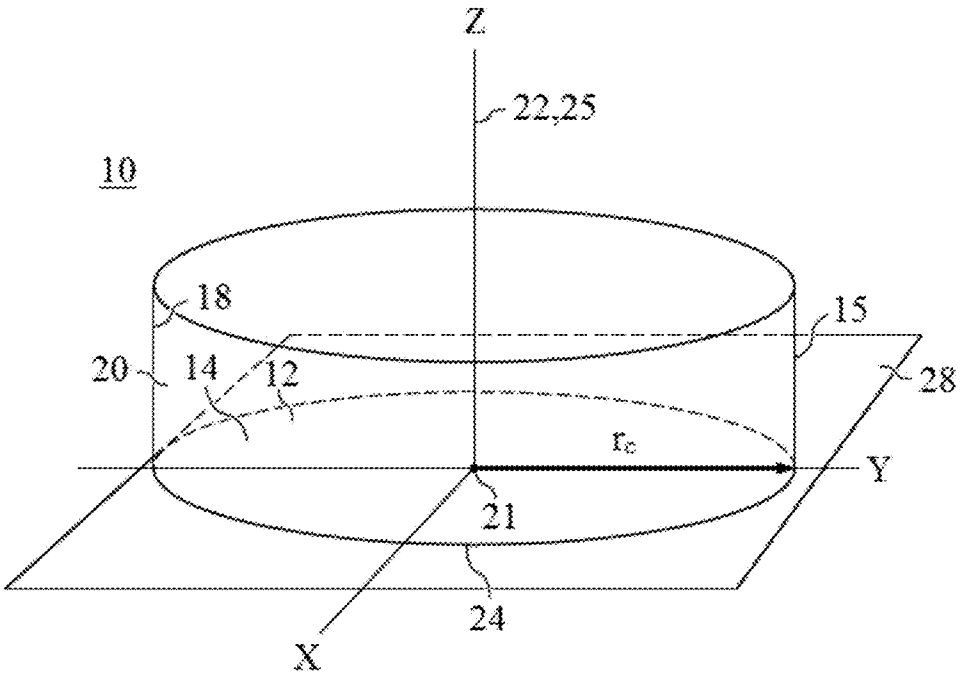
FIG. 1 is a depiction of a perspective view of a mold.

The term "substantially circular cross section" as used herein and in the appended claims in reference to a mold cavity (20) means that the longest radius, $r_c$, of the mold cavity (20) projected onto the x-y plane (28) from the mold cavity's central axis, $C_{axis}$, (22) to a vertical internal boundary (18) of a surrounding wall (15) is ≤20% longer than the shortest radius, $r_c$, of the mold cavity (20) projected onto the x-y plane (28) from the mold cavity's central axis, $C_{axis}$, (22) to the vertical internal boundary (18). (See FIG. 1).

The term "mold cavity" as used herein and in the appended claims refers to the volume defined by a base (12) and a vertical internal boundary (18) of a surrounding wall (15). (See FIG. 1).

The term "substantially perpendicular" as used herein and in the appended claims in reference to a first feature (e.g., a horizontal internal boundary; a vertical internal boundary) relative to a second feature (e.g., an axis, an x-y plane) means that the first feature is at an angle of 80 to 100° to the second feature.

The term "essentially perpendicular" as used herein and in the appended claims in reference to a first feature (e.g., a horizontal internal boundary; a vertical internal boundary) relative to a second feature (e.g., an axis, an x-y plane) means that the first feature is at an angle of 85 to 95° to the second feature.

Figure 2:
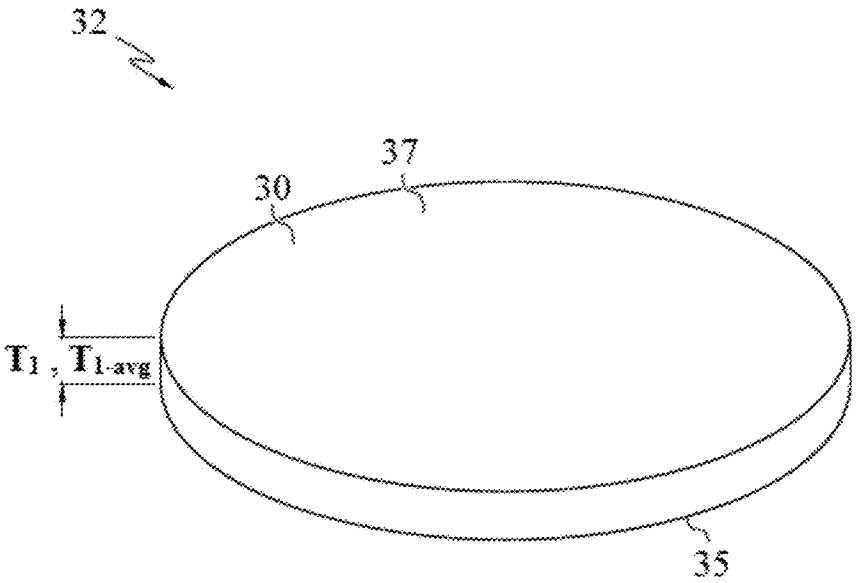
FIG. 2 is a depiction of a perspective view of a first polishing layer component.

The term "average first component thickness, $T_{1\text{-}avg}$" as used herein and in the appended claims in reference to the first polishing layer component (32) having a polishing side (37) means the average of the first component thickness, $T_1$, of the first polishing layer component (32) measured normal to the polishing sides (37) from the polishing side (37) to the base surface (35) of the first polishing layer component. (See FIG. 2).

Figure 3:
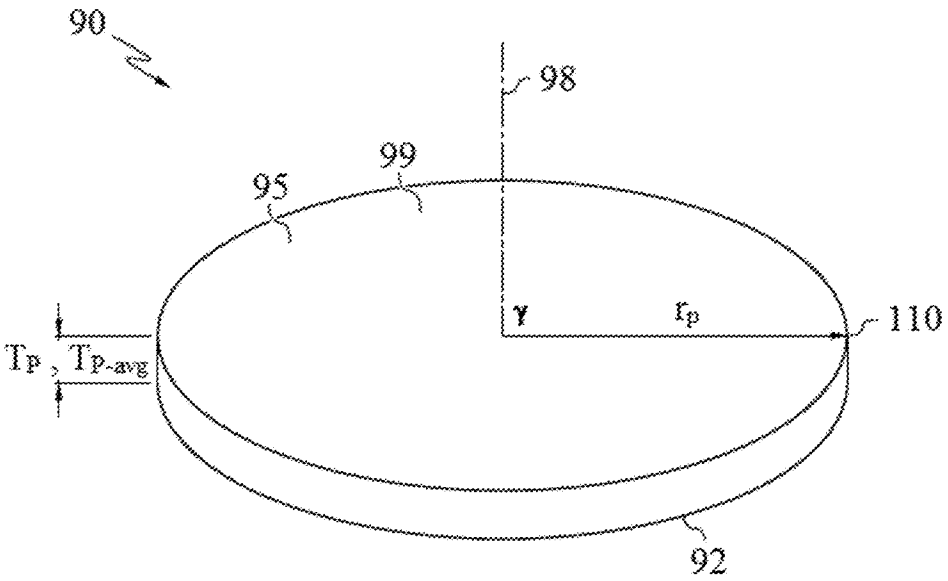
FIG. 3 is a depiction of a perspective view of a chemical mechanical polishing pad composite polishing layer.
Figure 4:
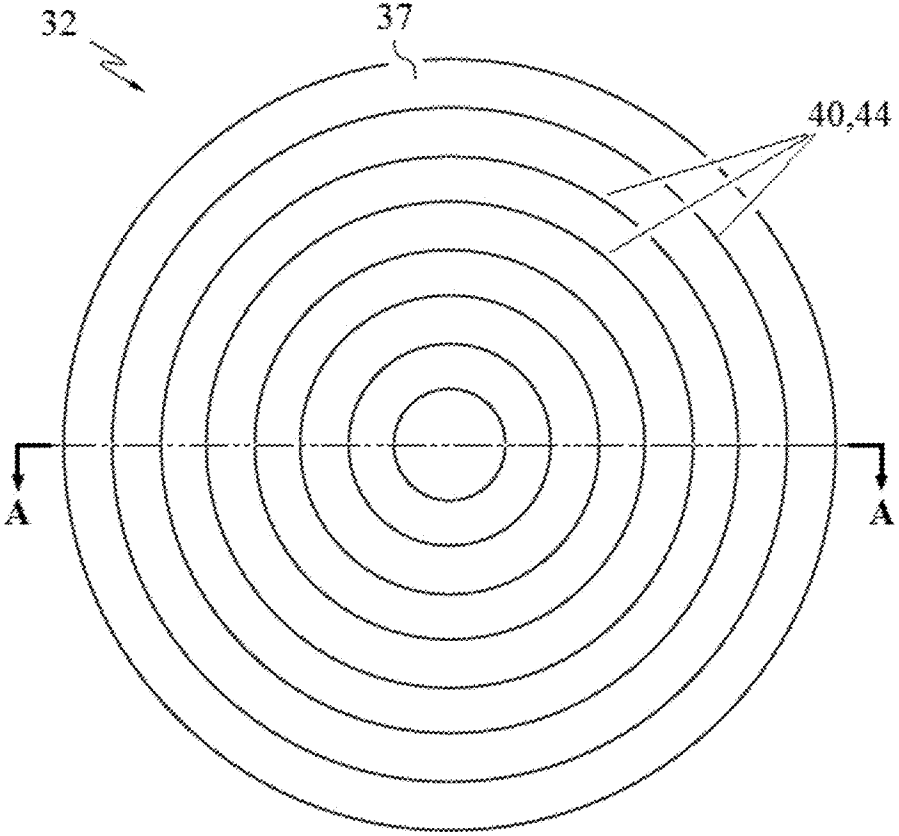
FIG. 4 is a depiction of a top plan view of a first polishing layer component.
Figure 5:
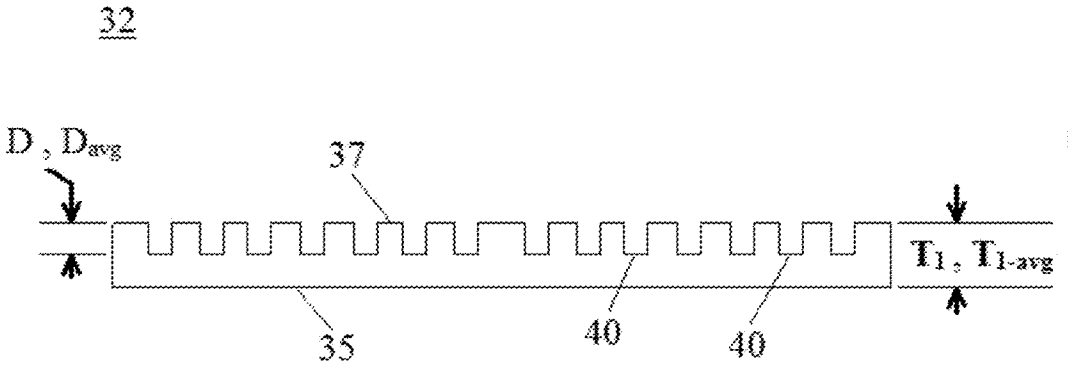
FIG. 5 is a cross sectional view taken along line A-A in FIG. 4.
Figure 6:
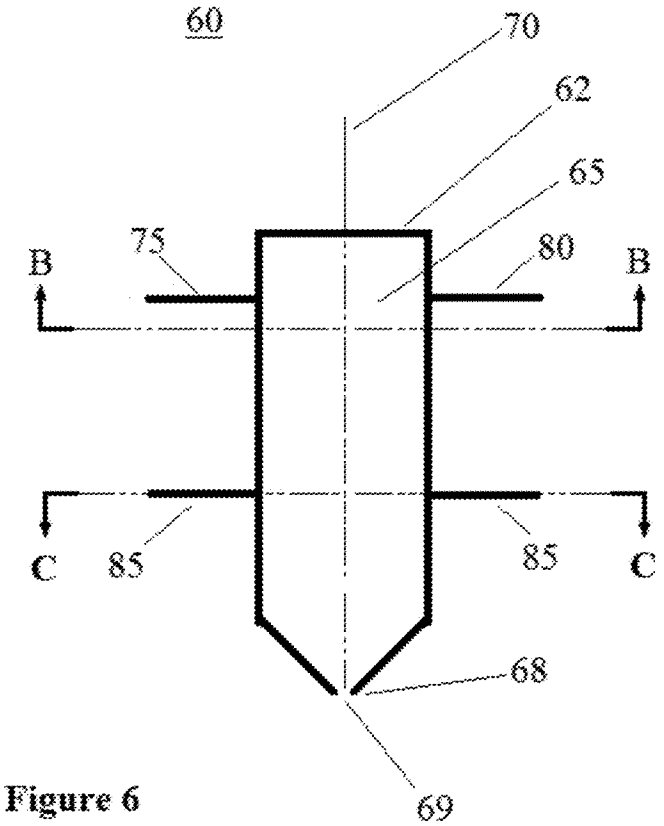
FIG. 6 is a depiction of a side elevational view of an axial mixing device for use in the method of the present invention.
Figure 7:
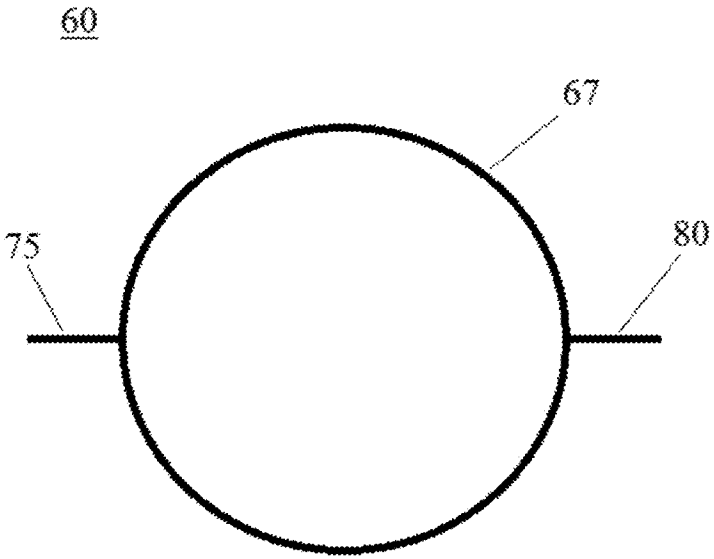
FIG. 7 is a cross sectional view taken along line B-B in FIG. 6.
Figure 8:
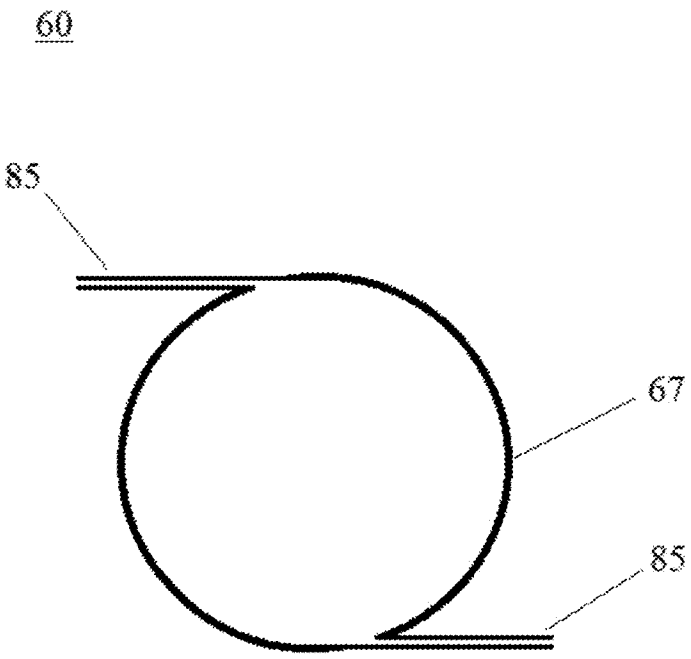
FIG. 8 is a cross sectional view taken along line C-C in FIG. 6.
Figure 9:
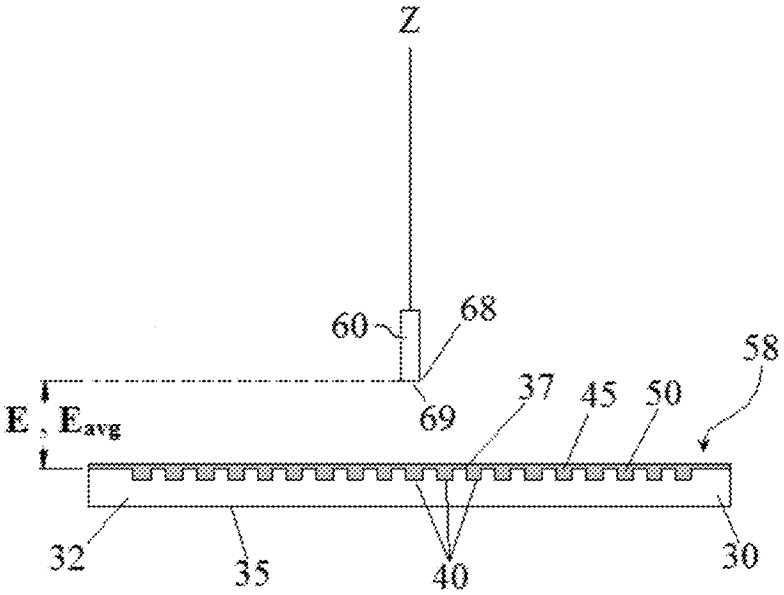
FIG. 9 is a depiction of a side elevational view of a composite structure formed in the method of the present invention.
Figure 10:
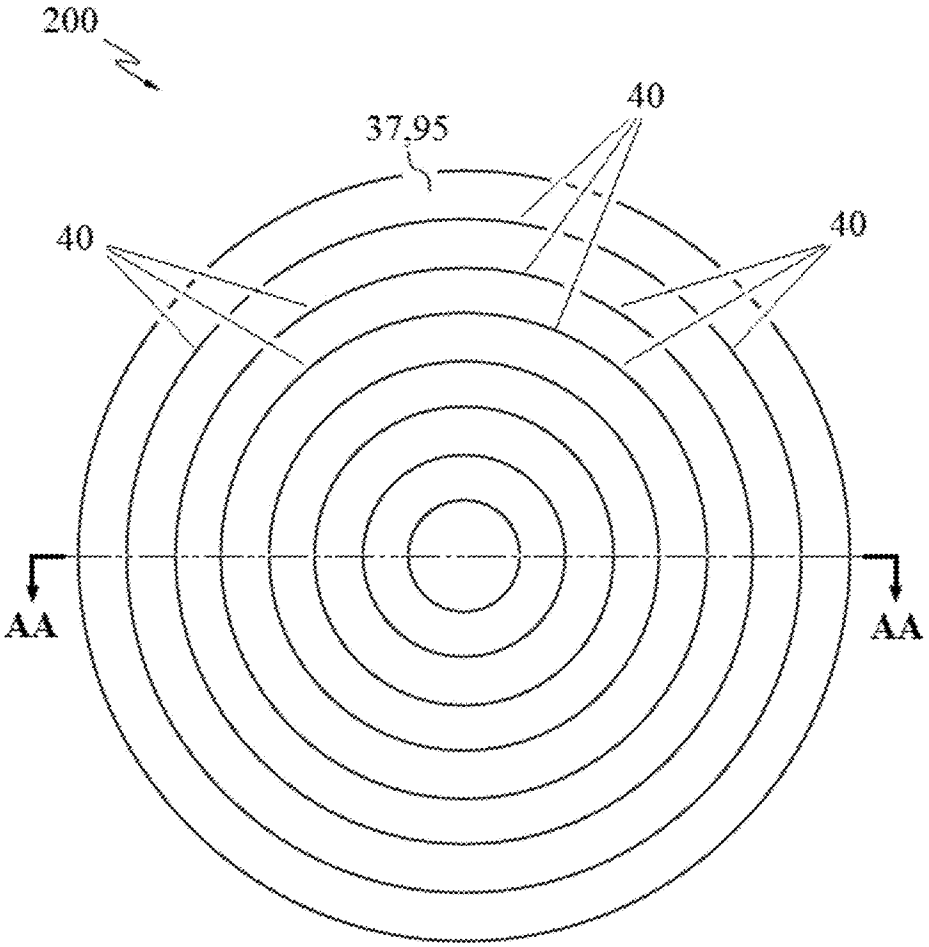
FIG. 10 is a depiction of a top plan view of a chemical mechanical polishing pad having a chemical mechanical polishing pad composite polishing layer of the present invention.
Figure 11:
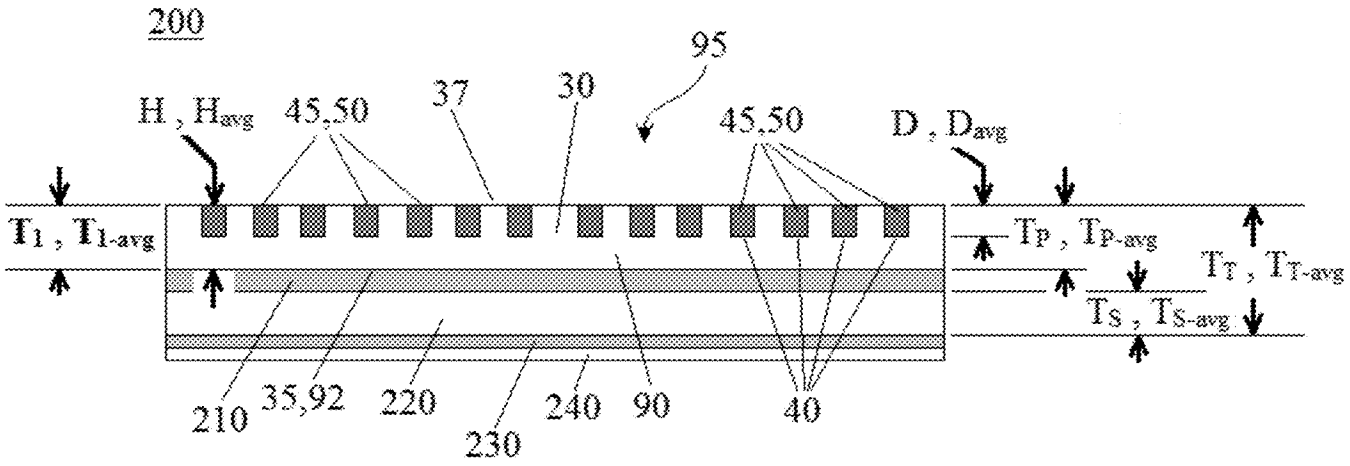
FIG. 11 is a cross sectional view taken along line AA-AA in FIG. 11.
Figure 12:
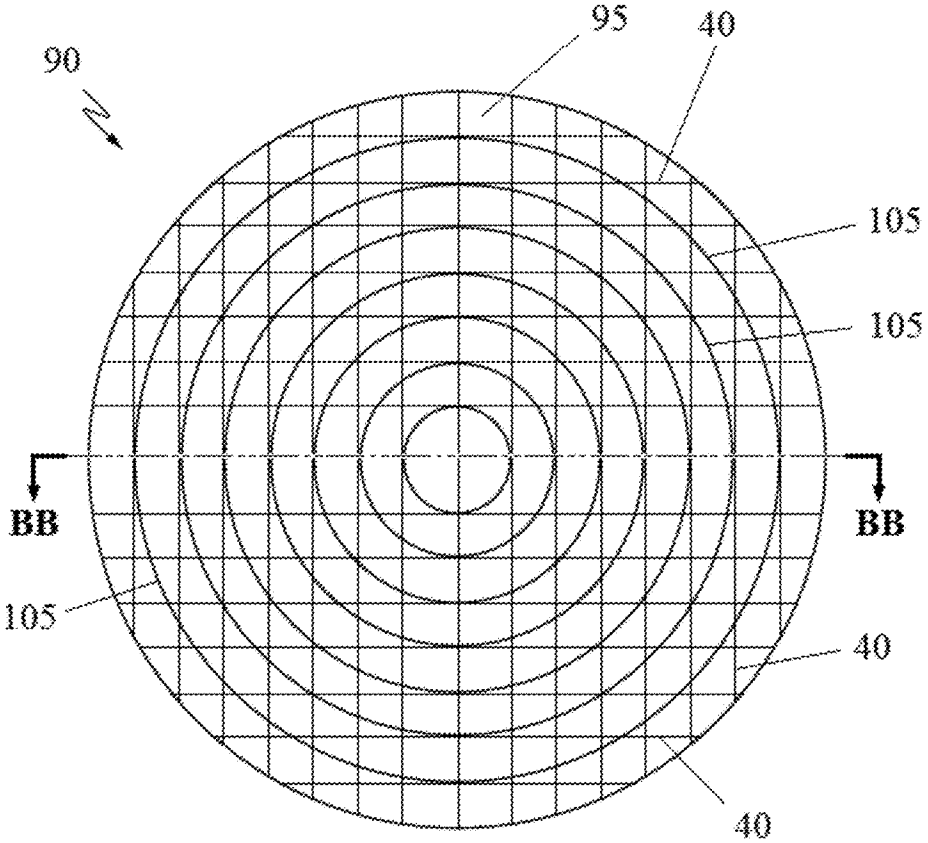
FIG. 12 is a depiction of a top plan view of a chemical mechanical polishing pad composite polishing layer of the present invention.
Figure 13A:
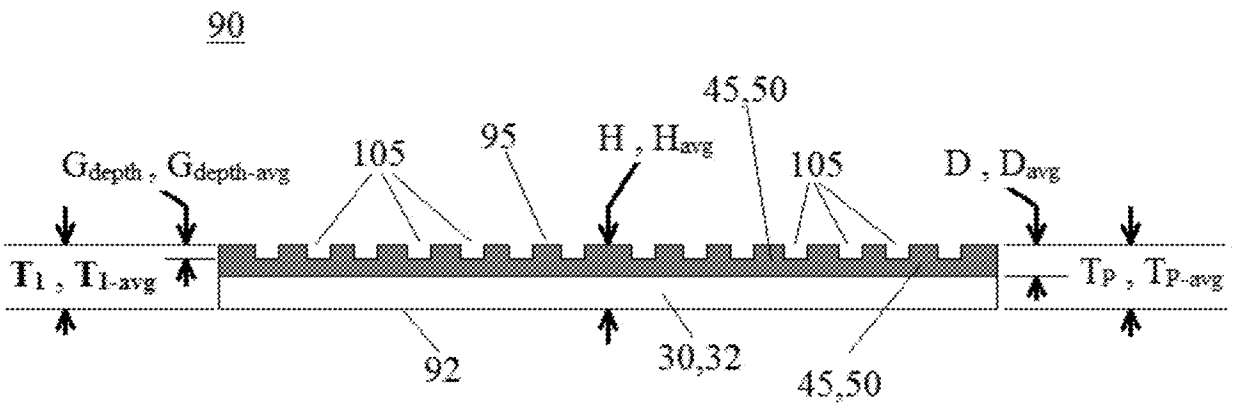
FIG. 13*a* is a cross sectional view taken along line BB-BB in FIG. 12.
Figure 13B:
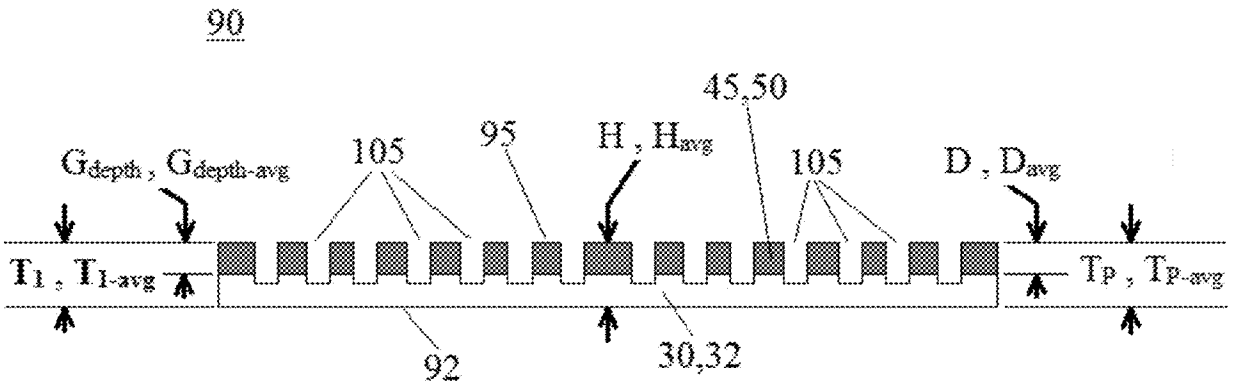
FIG. 13*b* is an alternative cross section view taken along line BB-BB in FIG. 12.
Figure 14:
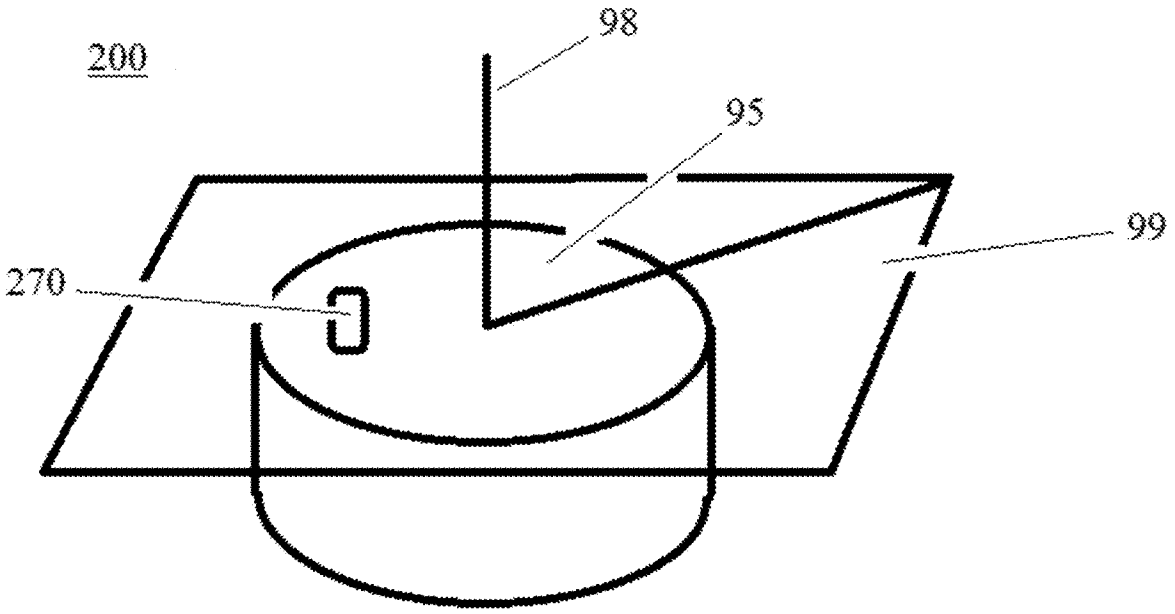
FIG. 14 is a depiction of a perspective view of a chemical mechanical polishing pad having a chemical mechanical polishing pad composite polishing layer and a window.

The term "average composite polishing layer thickness, $T_{P\text{-}avg}$" as used herein and in the appended claims in reference to a chemical mechanical polishing pad composite polishing layer (90) having a polishing surface (95) means the average polishing layer thickness, $T_P$, of the chemical mechanical polishing pad composite polishing layer (90) in a direction normal to the polishing surface (95) from the polishing surface (95) to the bottom surface (92) of the chemical mechanical polishing pad composite polishing layer (90). (See FIG. 3).

The term "substantially circular cross section" as used herein and in the appended claims in reference to a chemical mechanical polishing pad composite polishing layer (90) means that the longest radius, $r_p$, of the cross section from the central axis (98) of the chemical mechanical polishing pad composite polishing layer (90) to the outer perimeter (110) of the polishing surface (95) of the chemical mechanical polishing pad composite polishing layer (90) is ≤20% longer than the shortest radius, $r_p$, of the cross section from the central axis (98) to the outer perimeter (110) of the polishing surface (95). (See FIG. 3).

The chemical mechanical polishing pad composite polishing layer (90) of the present invention is preferably adapted for rotation about a central axis (98). Preferably, the polishing surface (95) of the chemical mechanical polishing pad composite polishing layer (90) is in a plane (99) perpendicular to the central axis (98). Preferably, the chemical mechanical polishing pad composite polishing layer (90) is adapted for rotation in a plane (99) that is at an angle, γ, of 85 to 95° to the central axis (98), preferably, of 90° to the central axis (98). Preferably, the chemical mechanical polishing pad composite polishing layer (90) has a polishing surface (95) that has a substantially circular cross section perpendicular to the central axis (98). Preferably, the radius, $r_p$, of the cross section of the polishing surface (95) perpendicular to the central axis (98) varies by ≤20% for the cross section, more preferably by ≤10% for the cross section. (See FIG. 3).

The term "gel time" as used herein and in the appended claims in reference to a combination of a poly side (P) liquid component and an iso side (I) liquid component formed in an axial mixing device of the present invention, means the total cure time for that combination determined using a standard test method according to ASTM D3795-00a (Reapproved 2006)(*Standard Test Method for Thermal Flow, Cure, and Behavior Properties of Pourable Thermosetting Materials by Torque Rheometer*).

The term "poly(urethane)" as used herein and in the appended claims encompasses (a) polyurethanes formed from the reaction of (i) isocyanates and (ii) polyols (including diols); and, (b) poly(urethane) formed from the reaction of (i) isocyanates with (ii) polyols (including diols) and (iii) water, amines or a combination of water and amines.

A method of forming a chemical mechanical polishing pad composite polishing layer (90), comprising: providing a first polishing layer component (32) of the chemical mechanical polishing pad composite polishing layer (90); wherein the first polishing layer component (32) has a polishing side (37), a base surface (35), a plurality of periodic recesses (40) and an average first component thickness, $T_{1\text{-}avg}$, measured normal to the polishing side (37) from the base surface (35) to the polishing side (37); wherein the first polishing layer component (32) comprises a first continuous non-fugitive polymeric phase (30); wherein the plurality of periodic recesses (40) have an average recess depth, $D_{avg}$, from the polishing side (37) measured normal to the polishing side (37) from the polishing side (37) toward the base surface (35), wherein the average recess depth, $D_{avg}$, is less than the average first component thickness, $T_{1\text{-}avg}$; wherein the first continuous non-fugitive polymeric phase (30) is a reaction product of a first continuous phase isocyanate-terminated urethane prepolymer having 8 to 12 wt % unreacted NCO groups and a first continuous phase curative; providing a poly side (P) liquid component, comprising at least one of a (P) side polyol, a (P) side polyamine and a (P) side alcohol amine; providing an iso side (I) liquid component, comprising at least one polyfunctional isocyanate; providing a pressurized gas; providing an axial mixing device (60) having an internal cylindrical chamber (65); wherein the internal cylindrical chamber (65) has a closed end (62), an open end (68), an axis of symmetry (70), at least one (P) side liquid feed port (75) that opens into the internal cylindrical chamber (65), at least one (I) side liquid feed port (80) that opens into the internal cylindrical chamber (65), and at least one (preferably, at least two) tangential pressurized gas feed port (85) that opens into the internal cylindrical chamber (65); wherein the closed end (62) and the open end (68) are perpendicular to the axis of symmetry (70); wherein the at least one (P) side liquid feed port (75) and the at least one (I) side liquid feed port (80) are arranged along a circumference of the internal cylindrical chamber (65) proximate the closed end (62); wherein the at least one (preferably, at least two) tangential pressurized gas feed (85) port is arranged along the circumference (67) of the internal cylindrical chamber (65) downstream of the at least one (P) side liquid feed port (75) and the at least one (I) side liquid feed port (80) from the closed end (62); wherein the poly side (P) liquid component is introduced into the internal cylindrical chamber (65) through the at least one (P) side liquid feed port (75) at a (P) side charge pressure of 6,895 to 27,600 kPa; wherein the iso side (I) liquid component is introduced into the internal cylindrical chamber (65) through the at least one (I) side liquid feed port (80) at an (I) side charge pressure of 6,895 to 27,600 kPa; wherein a combined mass flow rate of the poly side (P) liquid component and the iso side (I) liquid component to the internal cylindrical chamber is 1 to 500 g/s (preferably, 2 to 40 g/s; more preferably, 2 to 25 g/s); wherein the poly side (P) liquid component, the iso side (I) liquid component and the pressurized gas are intermixed within the internal cylindrical chamber (65) to form a combination; wherein the pressurized gas is introduced into the internal cylindrical chamber (65) through the at least one (preferably, at least two) tangential pressurized gas feed port (85) with a supply pressure of 150 to 1,500 kPa; wherein an inlet velocity into the internal cylindrical chamber (65) of the pressurized gas is 50 to 600 m/s calculated based on ideal gas conditions at 20° C. and 1 atm pressure, or, preferably, 75 to 350 m/s; discharging the combination from the open end (68) of the internal cylindrical chamber (65) toward the polishing side (37) of the first polishing layer component (32) at a velocity of 5 to 1,000 m/sec, or, preferably, from 10 to 600 m/sec or, more preferably, from 15 to 450 m/sec, filling the plurality of periodic recesses (40) with the combination; allowing the combination to solidify as a second polishing layer component (45) in the plurality of periodic recesses (40) to form a composite structure (58); wherein the second polishing layer component (45) is a second non-fugitive polymeric phase (50); and, deriving the chemical mechanical polishing pad composite polishing layer (90) from the composite structure (58), wherein the chemical mechanical polishing pad composite polishing layer (90) has a polishing surface (95) on the polishing side (37) of the first polishing layer component (32); and wherein the polishing surface (95) is adapted for polishing a substrate. (See FIGS. 1-14).

Preferably, the first continuous non-fugitive polymeric phase (30) comprises a reaction product of a first continuous phase isocyanate-terminated urethane prepolymer having 8 to 12 wt % unreated NCO groups and a curative. More preferably, the first continuous non-fugitive polymeric phase (30) comprises a reaction product of a first continuous phase isocyanate-terminated urethane prepolymer having 8.75 to 12 wt % unreated NCO groups and a first continuous phase curative. More preferably, the first continuous non-fugitive polymeric phase (30) comprises a reaction product of a first continuous phase isocyanate-terminated urethane prepolymer having 9.0 to 9.25 wt % unreated NCO groups and a first continuous phase curative.

Preferably, the first continuous non-fugitive polymeric phase (30) is the reaction product of a first continuous phase isocyanate-terminated urethane prepolymer having 8 to 12 wt % unreated NCO groups and a first continuous phase curative; wherein the first continuous phase isocyanate-terminated urethane prepolymer is derived from the interaction of a first continuous phase polyisocyanate (preferably, a diisocyanate) with a first continuous phase polyol; wherein the first continuous phase polyol is selected from the group consisting of diols, polyols, polyol diols, copolymers thereof and mixtures thereof. Preferably, the first continuous phase polyol is selected from the group consisting of a polytetramethylene ether glycol (PTMEG); a blend of PTMEG with polypropylene glycol (PPG); and, mixtures thereof with low molecular weight diols (e.g., 1,2-butanediol; 1,3-butanediol; 1,4-butanediol).

Preferably, the first continuous non-fugitive polymeric phase (30) is the reaction product of a first continuous phase isocyanate-terminated urethane prepolymer having 8 to 12 wt % unreated NCO groups and a first continuous phase curative; wherein the first continuous phase curative is a first continuous phase polyamine. Preferably, the first continuous phase polyamine is an aromatic polyamine. More preferably, the first continuous phase polyamine is an aromatic polyamine selected from the group consisting of 4,4'-methylene-bis-o-chloroaniline (MbOCA), 4,4'-methylene-bis-(3-chloro-2,6-diethylaniline) (MCDEA); dimethylthiotoluenediamine; trimethyleneglycol di-p-aminobenzoate; polytetramethyleneoxide di-p-aminobenzoate; polytetramethyleneoxide mono-p-aminobenaoate; polypropyleneoxide di-p-aminobenzoate; polypropyleneoxide mono-p-aminobenzoate; 1,2-bis(2-aminophenylthio)ethane; 4,4'-methylene-bis-aniline; diethyltoluenediamine; 5-tert-butyl-2,4-toluenediamine; 3-tert-butyl-2,6-toluenediamine; 5-tert-amyl-2,4-toluenediamine; 3-tert-amyl-2,6-toluenediamine; 5-tert-amyl-2,4-chlorotoluenediamine; and 3-tert-amyl-2,6-chlorotoluenediamine. Most preferably, the first continuous phase polyamine is 4,4'-methylene-bis-o-chloroaniline (MbOCA).

Examples of commercially available PTMEG based isocyanate terminated urethane prepolymers include Imuthane® prepolymers (available from COIM USA, Inc., such as, PET-80A, PET-85A, PET-90A, PET-93A, PET-95A, PET-60D, PET-70D, PET-75D); Adiprene® prepolymers (available from Chemtura, such as, LF 800A, LF 900A, LF 910A, LF 930A, LF 931A, LF 939A, LF 950A, LF 952A, LF 600D, LF 601D, LF 650D, LF 667, LF 700D, LF750D, LF751D, LF752D, LF753D and L325); Andur® prepolymers (available from Anderson Development Company, such as, 70APLF, 80APLF, 85APLF, 90APLF, 95APLF, 60DPLF, 70APLF, 75APLF).

Preferably, the a first continuous phase isocyanate terminated urethane prepolymer used in the method of the present invention is a low free isocyanate terminated urethane prepolymer having less than 0.1 wt % free toluene diisocyanate (TDI) monomer content.

Preferably, the first continuous non-fugitive polymeric phase (30) can be provided in both porous and nonporous (i.e., unfilled) configurations. Preferably, the first continuous non-fugitive polymeric phase (30) has a specific gravity of ≥0.5 as measured according to ASTM D1622. More preferably, the first continuous non-fugitive polymeric phase (30) has a specific gravity of 0.5 to 1.2 (still more preferably, 0.55 to 1.1; most preferably 0.6 to 0.95) as measured according to ASTM D1622.

Preferably, the first continuous non-fugitive polymeric phase (30) has a Shore D hardness of 40 to 90 as measured according to ASTM D2240. More preferably, the first continuous non-fugitive polymeric phase (30) has a Shore D hardness of 50 to 75 as measured according to ASTM D2240. Most preferably, the first continuous non-fugitive polymeric phase (30) has a Shore D hardness of 55 to 70 as measured according to ASTM D2240.

Preferably, the first continuous non-fugitive polymeric phase (30) is porous. Preferably, the first continuous non-fugitive polymeric phase comprises a plurality of microelements. Preferably, the plurality of microelements are uniformly dispersed throughout the first continuous non-fugitive polymeric phase (30). Preferably, the plurality of microelements is selected from entrapped gas bubbles, hollow core polymeric materials, liquid filled hollow core polymeric materials, water soluble materials and an insoluble phase material (e.g., mineral oil). More preferably, the plurality of microelements is selected from entrapped gas bubbles and hollow core polymeric materials uniformly distributed throughout the first continuous non-fugitive polymeric phase (30). Preferably, the plurality of microelements has a weight average diameter of less than 150 μm (more preferably of less than 50 μm; most preferably of 10 to 50 μm). Preferably, the plurality of microelements comprise polymeric microballoons with shell walls of either polyacrylonitrile or a polyacrylonitrile copolymer (e.g., Expancel® from Akzo Nobel). Preferably, the plurality of microelements are incorporated into the first continuous non-fugitive polymeric phase (30) at 0 to 58 vol % porosity (more preferably, 1 to 58 vol %; most preferably, 10 to 35 vol % porosity). Preferably, the first continuous non-fugitive polymeric phase (30) has an open cell porosity of ≤6 vol % (more preferably, ≤5 vol %; still more preferably, ≤4 vol %; most preferably, ≤3 vol %).

Preferably, the first polishing layer component (32) provided in the method of making a chemical mechanical polishing pad composite polishing layer (90) of the present invention has a first component thickness, $T_1$, measured normal to the polishing side (37) from the base surface (35) to the polishing side (37). Preferably, the first polishing layer component (32) has an average first component thickness, $T_{1\text{-}avg}$, measured normal to the polishing side (37) from the base surface (35) to the polishing side (37). More preferably, the first polishing layer component (32) has an average first component thickness, $T_{1\text{-}avg}$, of 20 to 150 mils (more preferably, 30 to 125 mils; most preferably 40 to 120 mils). (See FIGS. 2 and 4-5).

Preferably, the first polishing layer component (32) has a plurality of periodic recesses (40) having a depth, D, measured normal to the polishing side (37) from the polishing surface (37) toward the base surface. Preferably, the plurality of periodic recesses (40) have an average depth, $D_{avg}$; wherein $D_{avg}<T_{1\text{-}avg}$. More preferably, the plurality of periodic recesses (40) have an average depth, $D_{avg}$; wherein $D_{avg}\leq 0.5*T_{1\text{-}avg}$ (more preferably, $D_{avg}\leq 0.4*T_{1\text{-}avg}$; most preferably, $D_{avg}\leq 0.375*T_{1\text{-}avg}$). (See FIGS. 4-5).

Preferably, the plurality of periodic recesses (40) are selected from curved recesses, linear recesses and combinations thereof.

Preferably, the first polishing layer component has a plurality of periodic recesses, wherein the plurality of periodic recesses is a group of at least two concentric recesses. Preferably, the at least two concentric recesses have an average recess depth, $D_{avg}$, of ≥15 mils (preferably, 15 to 40 mils; more preferably, 25 to 35 mils; most preferably, 30 mils), a width of ≥5 mils (preferably, 5 to 150 mils; more preferably, 10 to 100 mils; most preferably, 15 to 50 mils) and a pitch of ≥10 mils (preferably, 25 to 150 mils; more preferably, 50 to 100 mils; most preferably, 60 to 80 mils). Preferably, the at least two concentric recesses have a width and a pitch, wherein the width and pitch are equal.

Preferably, the plurality of periodic recesses (40) can be selected from the group consisting of a plurality of disconnected periodic recesses and a plurality of interconnected periodic recesses. Preferably, when the plurality of periodic recesses is a plurality of disconnected periodic recesses, the second non-fugitive polymeric phase is a second discontinuous non-fugitive polymeric phase. Preferably, when the plurality of periodic recesses is a plurality of interconnected periodic recesses, the second non-fugitive polymeric phase is a second continuous non-fugitive polymeric phase.

Preferably, the axial mixing device (60) used in the method of the present invention has an internal cylindrical chamber (65). Preferably, the internal cylindrical chamber (65) has a closed end (62) and an open end (68). Preferably, the closed end (62) and the open end (68) are each substantially perpendicular to an axis of symmetry (70) of the internal cylindrical chamber (65). More preferably, the closed end (62) and the open end (68) are each essentially perpendicular to an axis of symmetry (70) of the internal cylindrical chamber (65). Most preferably, the closed end (62) and the open end (68) are each perpendicular to an axis of symmetry (70) of the internal cylindrical chamber (65). (See FIGS. 6-8).

Preferably, the axial mixing device (60) used in the method of the present invention has an internal cylindrical chamber (65) with an axis of symmetry (70), wherein the open end (68) has a circular opening (69). More preferably, the axial mixing device (60) used in the method of the present invention has an internal cylindrical chamber (65) with an axis of symmetry (70); wherein the open end (68) has a circular opening (69); and, wherein the circular opening (69) is concentric with the internal cylindrical chamber (65). Most preferably, the axial mixing device (60) used in the method of the present invention has an internal cylindrical chamber (65) with an axis of symmetry (70); wherein the open end (68) has a circular opening (69); wherein the circular opening (69) is concentric with the internal cylindrical chamber (65); and, wherein the circular opening (69) is perpendicular to the axis of symmetry (70) of the internal cylindrical chamber (65). Preferably, the circular opening (69) has a diameter of 1 to 10 mm (more preferably, 1.5 to 7.5 mm; still more preferably 2 to 6 mm; most preferably, 2.5 to 3.5 mm). (See FIGS. 6-8).

Preferably, the axial mixing device (60) used in the method of the present invention has at least one (P) side liquid feed port (75) that opens into the internal cylindrical chamber (65). More preferably, the axial mixing device (60) used in the method of the present invention has at least two (P) side liquid feed ports (75) that open into the internal cylindrical chamber (65). Preferably, when the axial mixing device (60) used in the method of the present invention has at least two (P) side liquid feed ports (75) that open into the internal cylindrical chamber (65), the at least two (P) side liquid feed ports (75) are arranged evenly about a circumference (67) of the internal cylindrical chamber (65). More preferably, when the axial mixing device (60) used in the method of the present invention has at least two (P) side liquid feed ports (75) that open into the internal cylindrical chamber (65), the at least two (P) side liquid feed ports (75) are arranged evenly about a circumference (67) of the internal cylindrical chamber (65) and are at an equal distance from the closed end (62) of the internal cylindrical chamber (65). Preferably, the at least one (P) side liquid feed port opens into the internal cylindrical chamber (65) through an orifice having an inner diameter of 0.05 to 3 mm (preferably, 0.1 to 0.1 mm; more preferably, 0.15 to 0.5 mm). Preferably, the at least one (P) side liquid feed port opens into the internal cylindrical chamber (65) and is directed toward the axis of symmetry (70) of the internal cylindrical chamber (65). More preferably, the at least one (P) side liquid feed port opens into the internal cylindrical chamber (65) and is directed toward and essentially perpendicular to the axis of symmetry (70) of the internal cylindrical chamber (65). Most preferably, the at least one (P) side liquid feed port opens into the internal cylindrical chamber (65) and is directed toward and perpendicular to the axis of symmetry (70) of the internal cylindrical chamber (65).

Preferably, the axial mixing device (60) used in the method of the present invention has at least one (I) side liquid feed port (80) that opens into the internal cylindrical chamber (65). More preferably, the axial mixing device (60) used in the method of the present invention has at least two (I) side liquid feed ports (80) that open into the internal cylindrical chamber (65). Preferably, when the axial mixing device (60) used in the method of the present invention has at least two (I) side liquid feed ports (80) that open into the internal cylindrical chamber (65), the at least two (I) side liquid feed ports (80) are arranged evenly about a circumference (67) of the internal cylindrical chamber (65). More preferably, when the axial mixing device (60) used in the method of the present invention has at least two (I) side liquid feed ports (80) that open into the internal cylindrical chamber (65), the at least two (I) side liquid feed ports (80) are arranged evenly about a circumference (67) of the internal cylindrical chamber (65) and are at an equal distance from the closed end (62) of the internal cylindrical chamber (65). Preferably, the at least one (I) side liquid feed port opens into the internal cylindrical chamber (65) through an orifice having an inner diameter of 0.05 to 3 mm (preferably, 0.1 to 0.1 mm; more preferably, 0.15 to 0.5 mm). Preferably, the at least one (I) side liquid feed port opens into the internal cylindrical chamber (65) through an orifice having an inner diameter of 0.05 to 1 mm (preferably, 0.1 to 0.75 mm; more preferably, 0.15 to 0.5 mm). Preferably, the at least one (I) side liquid feed port opens into the internal cylindrical chamber (65) and is directed toward the axis of symmetry (70) of the internal cylindrical chamber (65).

More preferably, the at least one (I) side liquid feed port opens into the internal cylindrical chamber (65) and is directed toward and essentially perpendicular to the axis of symmetry (70) of the internal cylindrical chamber (65). Most preferably, the at least one (I) side liquid feed port opens into the internal cylindrical chamber (65) and is directed toward and perpendicular to the axis of symmetry (70) of the internal cylindrical chamber (65).

Preferably, the axial mixing device (60) used in the method of the present invention has at least one (P) side liquid feed port (75) that opens into the internal cylindrical chamber (65) and at least one (I) side liquid feed port (80) that opens into the internal cylindrical chamber (65); wherein the at least one (P) side liquid feed port (75) and the at least one (I) side liquid feed port (80) are arranged evenly about the circumference (67) of the internal cylindrical chamber (65). More preferably, the axial mixing device (60) used in the method of the present invention has at least one (P) side liquid feed port (75) that opens into the internal cylindrical chamber (65) and at least one (I) side liquid feed port (80) that opens into the internal cylindrical chamber (65); wherein the at least one (P) side liquid feed port (75) and the at least one (I) side liquid feed port (80) are arranged evenly about a circumference (67) of the internal cylindrical chamber (65) and are at an equal distance from the closed end (62) of the internal cylindrical chamber (65).

Preferably, the axial mixing device (60) used in the method of the present invention has at least two (P) side liquid feed ports (75) that open into the internal cylindrical chamber (65) and at least two (I) side liquid feed ports (80) that open into the internal cylindrical chamber (65). Preferably, when the axial mixing device (60) used in the method of the present invention has at least two (P) side liquid feed ports (75) that open into the internal cylindrical chamber (65) and at least two (I) side liquid feed ports (80) that open into the internal cylindrical chamber (65), the at least two (P) side liquid feed ports (75) are arranged evenly about the circumference (67) of the internal cylindrical chamber (65) and the at least two (I) side liquid feed ports (80) are arranged evenly about the circumference (67) of the internal cylindrical chamber (65). Preferably, when the axial mixing device (60) used in the method of the present invention has at least two (P) side liquid feed ports (75) that open into the internal cylindrical chamber (65) and at least two (I) side liquid feed ports (80) that open into the internal cylindrical chamber (65), the (P) side liquid feed ports (75) and the (I) side liquid feed ports (80) alternate about the circumference (67) of the internal cylindrical chamber (65). More preferably, when the axial mixing device (60) used in the method of the present invention has at least two (P) side liquid feed ports (75) that open into the internal cylindrical chamber (65) and at least two (I) side liquid feed ports (80) that open into the internal cylindrical chamber (65), the (P) side liquid feed ports (75) and the (I) side liquid feed ports (80) alternate and are evenly spaced about the circumference (67) of the internal cylindrical chamber (65). Most preferably, when the axial mixing device (60) used in the method of the present invention has at least two (P) side liquid feed ports (75) that open into the internal cylindrical chamber (65) and at least two (I) side liquid feed ports (80) that open into the internal cylindrical chamber (65); the (P) side liquid feed ports (75) and the (I) side liquid feed ports (80) alternate and are evenly spaced about the circumference (67) of the internal cylindrical chamber (65); and, the (P) side liquid feed ports (75) and the (I) side liquid feed ports (80) are all at an equal distance from the closed end (62) of the internal cylindrical chamber (65).

Preferably, the axial mixing device (60) used in the method of the present invention has at least one tangential pressurized gas feed port (85) that opens into the internal cylindrical chamber (65). More preferably, the axial mixing device (60) used in the method of the present invention has at least one tangential pressurized gas feed port (85) that opens into the internal cylindrical chamber (65); wherein the at least one tangential pressurized gas feed port (85) is arranged along the circumference of the internal cylindrical chamber (65) downstream of the at least one (P) side liquid feed port (75) and the at least one (I) side liquid feed port (80) from the closed end (62). Still more preferably, the axial mixing device (60) used in the method of the present invention has at least two tangential pressurized gas feed ports (85) that open into the internal cylindrical chamber (65); wherein the at least two tangential pressurized gas feed ports (85) are arranged along the circumference of the internal cylindrical chamber (65) downstream of the at least one (P) side liquid feed port (75) and the at least one (I) side liquid feed port (80) from the closed end (62). Yet still more preferably, the axial mixing device (60) used in the method of the present invention has at least two tangential pressurized gas feed ports (85) that open into the internal cylindrical chamber (65); wherein the at least two tangential pressurized gas feed ports (85) are arranged along the circumference of the internal cylindrical chamber (65) downstream of the at least one (P) side liquid feed port (75) and the at least one (I) side liquid feed port (80) from the closed end (62); and, wherein the at least two tangential pressurized gas feed ports (85) are arranged evenly about a circumference (67) of the internal cylindrical chamber (65). Most preferably, the axial mixing device (60) used in the method of the present invention has at least two tangential pressurized gas feed ports (85) that open into the internal cylindrical chamber (65); wherein the at least two tangential pressurized gas feed ports (85) are arranged along the circumference of the internal cylindrical chamber (65) downstream of the at least one (P) side liquid feed port (75) and the at least one (I) side liquid feed port (80) from the closed end (62); and, wherein the at least two tangential pressurized gas feed ports (85) are arranged evenly about a circumference (67) of the internal cylindrical chamber (65) and are at an equal distance from the closed end (62) of the internal cylindrical chamber (65). Preferably, the at least one tangential pressurized gas feed port opens into the internal cylindrical chamber (65) through an orifice having a critical dimension of 0.1 to 5 mm (preferably, 0.3 to 3 mm; more preferably, 0.5 to 2 mm). Preferably, the at least one tangential pressurized gas feed port opens into the internal cylindrical chamber (65) and is directed tangentially along an internal circumference of the internal cylindrical chamber (65). More preferably, the at least one tangential pressurized gas feed port opens into the internal cylindrical chamber (65) and is directed tangentially along an internal circumference of the internal cylindrical chamber and on a plane that is essentially perpendicular to the axis of symmetry (70) of the internal cylindrical chamber (65). Most preferably, the at least one tangential pressurized gas feed port opens into the internal cylindrical chamber (65) and is directed tangentially along an internal circumference of the internal cylindrical chamber and on a plane that is perpendicular to the axis of symmetry (70) of the internal cylindrical chamber (65).

Preferably, in the method of the present invention, the poly side (P) liquid component, comprises at least one of a (P) side polyol, a (P) side polyamine and a (P) side alcohol amine.

Preferably, the (P) side polyol is selected from the group consisting of diols, polyols, polyol diols, copolymers thereof and mixtures thereof. More preferably, the (P) side polyol is selected from the group consisting of polyether polyols (e.g., poly(oxytetramethylene)glycol, poly(oxypropylene)glycol and mixtures thereof); polycarbonate polyols; polyester polyols; polycaprolactone polyols; mixtures thereof; and, mixtures thereof with one or more low molecular weight polyols selected from the group consisting of ethylene glycol; 1,2-propylene glycol; 1,3-propylene glycol; 1,2-butanediol; 1,3-butanediol; 2-methyl-1,3-propanediol; 1,4-butanediol; neopentyl glycol; 1,5-pentanediol; 3-methyl-1,5-pentanediol; 1,6-hexanediol; diethylene glycol; dipropylene glycol; and, tripropylene glycol. Still more preferably, the at least one (P) side polyol is selected from the group consisting of polytetramethylene ether glycol (PTMEG); ester based polyols (such as ethylene adipates, butylene adipates); polypropylene ether glycols (PPG); polycaprolactone polyols; copolymers thereof; and, mixtures thereof.

Preferably, in the method of the present invention, the poly side (P) liquid component used contains at least one (P) side polyol; wherein the at least one (P) side polyol includes a high molecular weight polyol having a number average molecular weight, $M_N$, of 2,500 to 100,000. More preferably, the high molecular weight polyol used has a number average molecular weight, $M_N$, of 5,000 to 50,000 (still more preferably 7,500 to 25,000; most preferably 10,000 to 12,000).

Preferably, in the method of the present invention, the poly side (P) liquid component used contains at least one (P) side polyol; wherein the at least one (P) side polyol includes a high molecular weight polyol having an average of three to ten hydroxyl groups per molecule. More preferably, the high molecular weight polyol used has an average of four to eight (still more preferably five to seven; most preferably six) hydroxyl groups per molecule.

Examples of commercially available high molecular weight polyols include Specflex® polyols, Voranol® polyols and Voralux® polyols (available from The Dow Chemical Company); Multranol® Specialty Polyols and Ultracel® Flexible Polyols (available from Bayer MaterialScience LLC); and Pluracol® Polyols (available from BASF). A number of preferred high molecular weight polyols are listed in TABLE 1.

TABLE 1

| High molecular weight polyol | Number of OH groups per molecule | $M_N$ | Hydroxyl Number (mg KOH/g) |
|---|---|---|---|
| Multranol ® 3901 Polyol | 3.0 | 6,000 | 28 |
| Pluracol ® 1385 Polyol | 3.0 | 3,200 | 50 |
| Pluracol ® 380 Polyol | 3.0 | 6,500 | 25 |
| Pluracol ® 1123 Polyol | 3.0 | 7,000 | 24 |
| ULTRACEL ® 3000 Polyol | 4.0 | 7,500 | 30 |
| SPECFLEX ® NC630 Polyol | 4.2 | 7,602 | 31 |
| SPECFLEX ® NC632 Polyol | 4.7 | 8,225 | 32 |
| VORALUX ® HF 505 Polyol | 6.0 | 11,400 | 30 |
| MULTRANOL ® 9185 Polyol | 6.0 | 3,366 | 100 |
| VORANOL ® 4053 Polyol | 6.9 | 12,420 | 31 |

Preferably, the (P) side polyamine is selected from the group consisting of diamines and other multifunctional amines. More preferably, the (P) side polyamine is selected from the group consisting of aromatic diamines and other multifunctional aromatic amines; such as, for example, 4,4'-methylene-bis-o-chloroaniline ("MbOCA"); 4,4'-methylene-bis-(3-chloro-2,6-diethylaniline) ("MCDEA"); dimethylthiotoluenediamine; trimethyleneglycol di-p-aminobenzoate; polytetramethyleneoxide di-p-aminobenzoate; polytetramethyleneoxide mono-p-aminobenzoate; polypropyleneoxide di-p-aminobenzoate; polypropyleneoxide mono-p-aminobenzoate; 1,2-bis(2-aminophenylthio)ethane; 4,4'-methylene-bis-aniline; diethyltoluenediamine; 5-tert-butyl-2,4-toluendiamine; 3-tert-butyl-2,6-toluenediamine; 5-tert-amyl-2,4-toluenediamine; and 3-tert-amyl-2,6-toluenediamine and chlorotoluenediamine.

Preferably, the (P) side alcohol amine is selected from the group consisting amine initiated polyols. More preferably, the (P) side alcohol amine is selected from the group consisting amine initiated polyols containing one to four (still more preferably, two to four; most preferably, two) nitrogen atoms per molecule. Preferably, the (P) side alcohol amine is selected from the group consisting amine initiated polyols that have an average of at least three hydroxyl groups per molecule. More preferably, the (P) side alcohol amine is selected from the group consisting of amine initiated polyols that have an average of three to six (still more preferably, three to five; most preferably, four) hydroxyl groups per molecule. Particularly preferred amine initiated polyols a number average molecular weight, $M_N$, of ≤700 (preferably, of 150 to 650; more preferably, of 200 to 500; most preferably 250 to 300) and have a hydroxyl number (as determined by ASTM Test Method D4274-11) of 350 to 1,200 mg KOH/g. More preferably, the amine initiated polyol used has a hydroxyl number of 400 to 1,000 mg KOH/g (most preferably 600 to 850 mg KOH/g). Examples of commercially available amine initiated polyols include the Voranol® family of amine initiated polyols (available from The Dow Chemical Company); the Quadrol® Specialty Polyols (N,N,N',N'-tetrakis(2-hydroxypropyl ethylene diamine))(available from BASF); Pluracol® amine based polyols (available from BASF); Multranol® amine based polyols (available from Bayer MaterialScience LLC); triisopropanolamine (TIPA) (available from The Dow Chemical Company); and, triethanolamine (TEA) (available from Mallinckrodt Baker Inc.). A number of preferred amine initiated polyols are listed in TABLE 2.

TABLE 2

| Amine initiated polyol | Number of OH groups per molecule | $M_N$ | Hydroxyl Number (mg KOH/g) |
|---|---|---|---|
| Triethanolamine | 3 | 149 | 1130 |
| Triisopropanolamine | 3 | 192 | 877 |
| MULTRANOL ® 9138 Polyol | 3 | 240 | 700 |
| MULTRANOL ® 9170 Polyol | 3 | 481 | 350 |
| VORANOL ® 391 Polyol | 4 | 568 | 391 |
| VORANOL ® 640 Polyol | 4 | 352 | 638 |
| VORANOL ® 800 Polyol | 4 | 280 | 801 |
| QUADROL ® Polyol | 4 | 292 | 770 |
| MULTRANOL ® 4050 Polyol | 4 | 356 | 630 |
| MULTRANOL ® 4063 Polyol | 4 | 488 | 460 |
| MULTRANOL ® 8114 Polyol | 4 | 568 | 395 |
| MULTRANOL ® 8120 Polyol | 4 | 623 | 360 |
| MULTRANOL ® 9181 Polyol | 4 | 291 | 770 |
| VORANOL ® 202 Polyol | 5 | 590 | 475 |

Preferably, in the method of the present invention, the poly side (P) liquid component is introduced into the internal cylindrical chamber (65) through the at least one (P) side liquid feed port (75) at a (P) side charge pressure of 6,895 to 27,600 kPa. More preferably, the poly side (P) liquid component is introduced into the internal cylindrical chamber (65) through the at least one (P) side liquid feed port (75)

at a (P) side charge pressure of 8,000 to 20,000 kPa. Most preferably, the poly side (P) liquid component is introduced into the internal cylindrical chamber (65) through the at least one (P) side liquid feed port (75) at a (P) side charge pressure of 10,000 to 17,000 kPa.

Preferably, in the method of the present invention, the iso side (I) liquid component, comprises at least one polyfunctional isocyanate. Preferably, the at least one polyfunctional isocyanate contains two reactive isocyanate groups (i.e., NCO).

Preferably, the at least one polyfunctional isocyanate is selected from the group consisting of an aliphatic polyfunctional isocyanate, an aromatic polyfunctional isocyanate and a mixture thereof. More preferably, the polyfunctional isocyanate is a diisocyanate selected from the group consisting of 2,4-toluene diisocyanate; 2,6-toluene diisocyanate; 4,4'-diphenylmethane diisocyanate; naphthalene-1,5-diisocyanate; tolidine diisocyanate; para-phenylene diisocyanate; xylylene diisocyanate; isophorone diisocyanate; hexamethylene diisocyanate; 4,4'-dicyclohexylmethane diisocyanate; cyclohexanediisocyanate; and, mixtures thereof. Still more preferably, the at least one polyfunctional isocyanate is an isocyanate terminated urethane prepolymer formed by the reaction of a diisocyanate with a prepolymer polyol.

Preferably, the at least one polyfunctional isocyanate is an isocyanate-terminated urethane prepolymer; wherein the isocyanate-terminated urethane prepolymer has 2 to 12 wt % unreacted isocyanate (NCO) groups. More preferably, the isocyanate-terminated urethane prepolymer used in the method of the present invention has 2 to 10 wt % (still more preferably 4 to 8 wt %; most preferably 5 to 7 wt %) unreacted isocyanate (NCO) groups.

Preferably, the isocyanate terminated urethane prepolymer used is the reaction product of a diisocyanate with a prepolymer polyol; wherein the prepolymer polyol is selected from the group consisting of diols, polyols, polyol diols, copolymers thereof and mixtures thereof. More preferably, the prepolymer polyol is selected from the group consisting of polyether polyols (e.g., poly(oxytetramethylene)glycol, poly(oxypropylene)glycol and mixtures thereof); polycarbonate polyols; polyester polyols; polycaprolactone polyols; mixtures thereof; and, mixtures thereof with one or more low molecular weight polyols selected from the group consisting of ethylene glycol; 1,2-propylene glycol; 1,3-propylene glycol; 1,2-butanediol; 1,3-butanediol; 2-methyl-1,3-propanediol; 1,4-butanediol; neopentyl glycol; 1,5-pentanediol; 3-methyl-1,5-pentanediol; 1,6-hexanediol; diethylene glycol; dipropylene glycol; and, tripropylene glycol. Still more preferably, the prepolymer polyol is selected from the group consisting of polytetramethylene ether glycol (PTMEG); ester based polyols (such as ethylene adipates, butylene adipates); polypropylene ether glycols (PPG); polycaprolactone polyols; copolymers thereof and, mixtures thereof. Most preferably, the prepolymer polyol is selected from the group consisting of PTMEG and PPG.

Preferably, when the prepolymer polyol is PTMEG, the isocyanate terminated urethane prepolymer has an unreacted isocyanate (NCO) concentration of 2 to 10 wt % (more preferably of 4 to 8 wt %; most preferably 6 to 7 wt %). Examples of commercially available PTMEG based isocyanate terminated urethane prepolymers include Imuthane® prepolymers (available from COIM USA, Inc., such as, PET-80A, PET-85A, PET-90A, PET-93A, PET-95A, PET-60D, PET-70D, PET-75D); Adiprene® prepolymers (available from Chemtura, such as, LF 800A, LF 900A, LF 910A, LF 930A, LF 931A, LF 939A, LF 950A, LF 952A, LF 600D, LF 601D, LF 650D, LF 667, LF 700D, LF750D, LF751D, LF752D, LF753D and L325); Andur® prepolymers (available from Anderson Development Company, such as, 70APLF, 80APLF, 85APLF, 90APLF, 95APLF, 60DPLF, 70APLF, 75APLF).

Preferably, when the prepolymer polyol is PPG, the isocyanate terminated urethane prepolymer has an unreacted isocyanate (NCO) concentration of 3 to 9 wt % (more preferably 4 to 8 wt %, most preferably 5 to 6 wt %). Examples of commercially available PPG based isocyanate terminated urethane prepolymers include Imuthane® prepolymers (available from COIM USA, Inc., such as, PPT-80A, PPT-90A, PPT-95A, PPT-65D, PPT-75D); Adiprene® prepolymers (available from Chemtura, such as, LFG 963A, LFG 964A, LFG 740D); and, Andur® prepolymers (available from Anderson Development Company, such as, 8000APLF, 9500APLF, 6500DPLF, 7501DPLF).

Preferably, the isocyanate terminated urethane prepolymer used in the method of the present invention is a low free isocyanate terminated urethane prepolymer having less than 0.1 wt % free toluene diisocyanate (TDI) monomer content.

Non-TDI based isocyanate terminated urethane prepolymers can also be used in the method of the present invention. For example, isocyanate terminated urethane prepolymers include those formed by the reaction of 4,4'-diphenylmethane diisocyanate (MDI) and polyols such as polytetramethylene glycol (PTMEG) with optional diols such as 1,4-butanediol (BDO) are acceptable. When such isocyanate terminated urethane prepolymers are used, the unreacted isocyanate (NCO) concentration is preferably 4 to 10 wt % (more preferably 4 to 8 wt %, most preferably 5 to 7 wt %). Examples of commercially available isocyanate terminated urethane prepolymers in this category include Imuthane® prepolymers (available from COIM USA, Inc. such as 27-85A, 27-90A, 27-95A); Andur® prepolymers (available from Anderson Development Company, such as, IE75AP, IE80AP, IE 85AP, IE90AP, IE95AP, IE98AP); Vibrathane® prepolymers (available from Chemtura, such as, B625, B635, B821); Isonate® modified prepolymer (available from The Dow Chemical Company, such as, Isonate® 240 with 18.7% NCO, Isonate® 181 with 23% NCO, Isonate® 143L with 29.2% NCO); and, polymeric MDI (available from The Dow Chemical Company, such as, PAPI® 20, 27, 94, 95, 580N, 901).

Preferably, in the method of the present invention, the iso side (I) liquid component is introduced into the internal cylindrical chamber (65) through the at least one (I) side liquid feed port (80) at an (I) side charge pressure of 6,895 to 27,600 kPa. More preferably, the iso side (I) liquid component is introduced into the internal cylindrical chamber (65) through the at least one (I) side liquid feed port (80) at an (I) side charge pressure of 8,000 to 20,000 kPa. Most preferably, the iso side (I) liquid component is introduced into the internal cylindrical chamber (65) through the at least one (I) side liquid feed port (80) at an (I) side charge pressure of 10,000 to 17,000 kPa.

Preferably, in the method of the present invention, at least one of the poly side (P) liquid component and the iso side (I) liquid component can optionally contain additional liquid materials. For example, at least one of the poly side (P) liquid component and the iso side (I) liquid component can contain liquid materials selected from the group consisting of foaming agents (e.g., carbamate foaming agents such as Specflex™ NR 556 $CO_2$/aliphatic amine adduct available from The Dow Chemical Company); catalyst (e.g., tertiary amine catalysts such as Dabco® 33LV catalyst available from Air Products, Inc.; and tin catalyst such as Fomrez® tin catalyst from Momentive); and surfactants (e.g., Tegostab® silicon surfactant from Evonik). Preferably, in the method of the present invention, the poly side (P) liquid component contains an additional liquid material. More preferably, in the method of the present invention, the poly side (P) liquid component contains an additional liquid material; wherein the additional liquid material is at least one of a catalyst and a surfactant. Most preferably, in the method of the present invention, the poly side (P) liquid component contains a catalyst and a surfactant.

Preferably, in the method of the present invention, the pressurized gas used is selected from the group consisting of carbon dioxide, nitrogen, air and argon. More preferably, the pressurized gas used is selected from the group consisting of carbon dioxide, nitrogen and air. Still more preferably, the pressurized gas used is selected from the group consisting of nitrogen and air. Most preferably, the pressurized gas used is air.

Preferably, in the method of the present invention, the pressurized gas used has a water content of ≤10 ppm. More preferably, the pressurized gas used has a water content of ≤1 ppm. Still more preferably, the pressurized gas used has a water content of ≤0.1 ppm. Most preferably, the pressurized gas used has a water content of ≤0.01 ppm.

Preferably, in the method of the present invention, the pressurized gas is introduced into the internal cylindrical chamber (65) though the at least two tangential pressurized gas feed ports (85) with an inlet velocity, wherein the inlet velocity is 50 to 600 m/s calculated based on ideal gas conditions at 20° C. and 1 atm pressure, or, preferably, 75 to 350 m/s. Without wishing to be bound by theory, it is noted that when the inlet velocity is too low, the polishing layer deposited in the mold has an increased likelihood of developing undesirable cracks.

Preferably, in the method of the present invention, the pressurized gas is introduced into the internal cylindrical chamber (65) through the at least two tangential pressurized gas feed ports (85) with a supply pressure of 150 to 1,500 kPa. More preferably, the pressurized gas is introduced into the internal cylindrical chamber (65) through the at least two tangential pressurized gas feed ports (85) with a supply pressure of 350 to 1,000 kPa. Most preferably, the pressurized gas is introduced into the internal cylindrical chamber (65) through the at least two tangential pressurized gas feed ports (85) with a supply pressure of 550 to 830 kPa.

Preferably, the method of forming a chemical mechanical polishing pad polishing layer of the present invention, comprises: providing a poly side (P) liquid component and an iso side (I) liquid component; wherein the poly side (P) liquid component and the iso side (I) liquid component are provided at a stoichiometric ratio of the reactive hydrogen groups (i.e., the sum of the amine ($NH_2$) groups and the hydroxyl (OH) groups) in the components of the poly side (P) liquid component to the unreacted isocyanate (NCO) groups in the iso side (I) liquid component of 0.85 to 1.15 (more preferably 0.90 to 1.10; most preferably 0.95 to 1.05).

Preferably, in the method of the present invention, the combined mass flow rate of the poly side (P) liquid component and the iso side (I) liquid component to the internal cylindrical chamber (65) is 1 to 500 g/s (preferably, 2 to 40 g/s; more preferably, 2 to 25 g/s).

Preferably, in the method of the present invention, the ratio of (a) the sum of the combined mass flow rate of the poly side (P) liquid component and the iso side (I) liquid component to the internal cylindrical chamber (65) to (b) the mass flow of the pressurized gas to the internal cylindrical chamber (65) (calculated based on ideal gas conditions at 20° C. and 1 atm pressure) is ≤46 to 1 (more preferably, ≤30 to 1).

Preferably, in the method of the present invention, the combination formed in the axial mixing device (60) is discharged from the open end (68) of the internal cylindrical chamber (65) toward the polishing side (37) of the first polishing layer component (32) at a velocity of 10 to 300 m/sec, filling the plurality of periodic recesses (40) with the combination and allowing the combination to solidify to form a composite structure (58). More preferably, the combination is discharged from the opening (69) at the open end (68) of the axial mixing device (60) with a velocity having a z-component in a direction parallel to the z axis (Z) toward the polishing side (37) of the first polishing layer component (32) of 10 to 300 m/sec, filling the plurality of periodic recesses (40) with the combination and allowing the combination to solidify to form a composite structure (58). (See FIG. 9).

Preferably, in the method of the present invention, the combination is discharged from the open end (68) of the axial mixing device (60) at an elevation, E, in the z dimension above the polishing side (37) of the first polishing layer component (32). More preferably, the combination is discharged from the open end (68) of the axial mixing device (60) at an elevation, E; wherein the average elevation, E, is 2.5 to 125 cm (more preferably, 7.5 to 75 cm; most preferably, 12.5 to 50 cm). (See FIG. 9).

Preferably, in the method of the present invention, the combination formed in the axial mixing device has a gel time of 5 to 900 seconds. More preferably, the combination formed in the axial mixing device has a gel time of 10 to 600 seconds. Most preferably, the combination formed in the axial mixing device has a gel time of 15 to 120 seconds.

One of ordinary skill in the art will understand to select a chemical mechanical polishing pad composite polishing layer (90) having a polishing layer thickness, $T_P$, suitable for use in a chemical mechanical polishing pad (200) for a given polishing operation. Preferably, the chemical mechanical polishing pad composite polishing layer (90) has an average polishing layer thickness, $T_{P\text{-}avg}$, along an axis (98) perpendicular to a plane (99) of the polishing surface (95). More preferably, the average polishing layer thickness, $T_{P\text{-}avg}$, is 20 to 150 mils (more preferably, 30 to 125 mils; most preferably, 40 to 120 mils). Most preferably, the average polishing layer thickness, $T_{P\text{-}avg}$, is equal to the average first component thickness, $T_1$-avg. (See FIGS. 3 and 10-11).

Preferably, the second polishing layer component (45) is a second non-fugitive polymeric phase (50) occupying the plurality of periodic recesses (40) in the chemical mechanical polishing pad composite polishing layer (90) of the present invention has a height, H, measured normal to the polishing surface (95) from the bottom surface (92) of polishing layer (90) toward the polishing surface (95). Preferably, the second polishing layer component (45) is a second non-fugitive polymeric phase (50) occupying the plurality of periodic recesses (40) has an average height, $H_{avg}$, measured normal to the polishing surface (95) from the bottom surface (92) of polishing layer (90) toward the polishing surface (95); wherein the absolute value of the difference, ΔS, between the average polishing layer thickness, $T_{P\text{-}avg}$, and the average height, $H_{avg}$, is ≤0.5 μm. More preferably, the absolute value of the difference, ΔS, is ≤0.2 μm. Still more preferably, the absolute value of the difference, ΔS, is ≤0.1 μm. Most preferably, the absolute value of the difference, ΔS, is ≤0.05 μm. (See, e.g. FIG. 11).

Preferably, the second polishing layer component (45) is a second non-fugitive polymeric phase (50) which occupies the plurality of periodic recesses (40) in the first continuous non-fugitive polymeric phase (30) of the first polishing layer component (32), wherein there are chemical bonds between the first continuous non-fugitive polymeric phase (30) and the second non-fugitive polymeric phase (50). More preferably, the second non-fugitive polymeric phase (50) occupies the plurality of periodic recesses (40) in the first continuous non-fugitive polymeric phase (30), wherein there are covalent bonds between the first continuous non-fugitive polymeric phase (30) and the second non-fugitive polymeric phase (50) such that the phases cannot be separated unless the covalent bonds between the phases are broken.

Preferably, in the method of the present invention, the combination solidifies as a second polishing layer component (45) in the plurality of recesses (40) to form a composite structure (58); wherein the second polishing layer component (45) is a second non-fugitive polymeric phase (50); and, the chemical mechanical polishing pad composite polishing layer (90) is derived from the composite structure (58), wherein the chemical mechanical polishing pad composite polishing layer (90) has a polishing surface (95) on the polishing side (37) of the first polishing layer component (32); wherein the polishing surface (95) is adapted for polishing a substrate.

Preferably, in the method of the present invention, deriving of the chemical mechanical polishing pad composite polishing layer (90) from the composite structure (58), further comprises: machining the composite structure (58) to derive the chemical mechanical polishing pad composite polishing layer (90). More preferably, machining the composite structure (58) to derive the chemical mechanical polishing pad composite polishing layer (90), wherein the chemical mechanical polishing pad composite polishing layer (90) so derived has an average polishing layer thickness, $T_{P\text{-}avg}$, measured normal to the polishing surface (95) from the bottom surface (92) to the polishing surface (95); wherein the average first component thickness, $T_{1\text{-}avg}$, equals the average polishing layer thickness, $T_{P\text{-}avg}$; wherein the second non-fugitive polymeric phase occupying the plurality of periodic recesses has an average height, $H_{avg}$, measured normal to the polishing surface (95) from the bottom surface (92) toward the polishing surface (95); and, wherein an absolute value of a difference, ΔS, between the average polishing layer thickness, $T_{P\text{-}avg}$, and the average height, $H_{avg}$, is ≤0.5 μm (preferably, ≤0.2 μm; more preferably, ≤0.1 μm; most preferably, ≤0.05 μm). (See, e.g., FIG. 11).

Preferably, in the method of the present invention, the composite structure (58) is machined by at least one of abrading (e.g., using a diamond conditioning disc); cutting; milling (e.g., using rotating cutting bits on a milling machine); lathing (e.g., using stationary cutting bits applied to a rotating composite structure (58)) and slicing. More preferably, in the method of the present invention, the composite structure (58) is machined by at least one of milling and lathing to derive the chemical mechanical polishing pad composite polishing layer (90).

Preferably, the chemical mechanical polishing pad composite polishing layer (90) prepared using the method of the present invention is adapted for polishing a substrate; wherein the substrate is at least one of a magnetic substrate, an optical substrate and a semiconductor substrate. More preferably, the chemical mechanical polishing pad composite polishing layer (90) prepared using the method of the present invention is adapted for polishing a substrate; wherein the substrate is a semiconductor substrate. Most preferably, the chemical mechanical polishing pad composite polishing layer (90) prepared using the method of the present invention is adapted for polishing a substrate; wherein the substrate is a semiconductor wafer.

Preferably, in the method of the present invention, the chemical mechanical polishing pad polishing composite polishing layer has a polishing surface with a groove pattern formed into the polishing surface. Preferably, the groove pattern comprises one or more grooves arranged on the polishing surface such that upon rotation of the chemical mechanical polishing pad composite polishing layer during polishing, the one or more grooves sweep over the surface of the substrate being polished. Preferably, the one or more grooves consist of curved grooves, linear grooves and combinations thereof.

Preferably, the groove pattern comprises a plurality of grooves. More preferably, the groove pattern is selected from a groove design. Preferably, the groove design is selected from the group consisting of concentric grooves (which may be circular or spiral), curved grooves, cross hatch grooves (e.g., arranged as an X-Y grid across the pad surface), other regular designs (e.g., hexagons, triangles), tire tread type patterns, irregular designs (e.g., fractal patterns), and combinations thereof. More preferably, the groove design is selected from the group consisting of random grooves, concentric grooves, spiral grooves, cross-hatched grooves, X-Y grid grooves, hexagonal grooves, triangular grooves, fractal grooves and combinations thereof. Most preferably, the polishing surface has a spiral groove pattern formed therein. The groove profile is preferably selected from rectangular with straight side walls or the groove cross section may be "V" shaped, "U" shaped, saw-tooth, and combinations thereof.

Preferably, the groove pattern comprises a plurality of grooves formed in the polishing surface of a chemical mechanical polishing pad composite polishing layer, wherein the plurality of grooves are curved grooves.

Preferably, the groove pattern comprises a plurality of grooves formed in the polishing surface of a chemical mechanical polishing pad composite polishing layer, wherein the plurality of grooves are concentric circular grooves.

Preferably, the groove pattern comprises a plurality of grooves formed in the polishing surface of a chemical mechanical polishing pad composite polishing layer, wherein the plurality of grooves are linear X-Y grooves.

Preferably, the groove pattern comprises a plurality of grooves formed in the polishing surface of a chemical mechanical polishing pad composite polishing layer, wherein the plurality of grooves comprise concentric circular grooves and linear X-Y grooves.

Preferably, the chemical mechanical polishing pad composite polishing layer (90) has at least one groove (105) formed in the polishing surface (95) opening at the polishing surface (95) and having a groove depth, $G_{depth}$, from the polishing surface (95) measured normal to the polishing surface (95) from the polishing surface (95) toward the bottom surface (92). More preferably, the at least one groove (105) has an average groove depth, $G_{depth\text{-}avg}$, of ≥10 mils (preferably, 10 to 150 mils). Still more preferably, the at least one groove (105) has an average groove depth, $G_{depth\text{-}avg}$, ≤ the average depth of the plurality of periodic recesses, $D_{avg}$. Preferably, the at least one groove (105) has an average groove depth, $G_{depth\text{-}avg}$, > the average depth of the plurality of periodic recesses, $D_{avg}$. Preferably, the at least one groove (105) forms a groove pattern that comprises at least two grooves (105) having a combination of an average groove depth, $G_{depth\text{-}avg}$, selected from ≥10 mils, ≥15 mils and 15 to 150 mils; a width selected from ≥10 mils and 10 to 100 mils; and a pitch selected from ≥30 mils, ≥50 mils, 50 to 200 mils, 70 to 200 mils, and 90 to 200 mils. Preferably, the at least one groove (105) is selected from (a) at least two concentric grooves; (b) at least one spiral groove; (c) a cross hatch groove pattern; and (d) a combination thereof. (See FIGS. 12, 13*a* and 13*b*).

Preferably, the chemical mechanical polishing pad composite polishing layer (90) prepared using the method of the present invention has an average polishing layer thickness, $T_{P\text{-}avg}$, of 20 to 150 mils. More preferably, the chemical mechanical polishing pad composite polishing layer (90) prepared using the method of the present invention has an average polishing layer thickness, $T_{P\text{-}avg}$, of 30 to 125 mils (still more preferably 40 to 120 mils; most preferably 50 to 100 mils). (See FIG. 3).

Preferably, in the method of the present invention, providing the first polishing layer component, further comprises: providing a mold (10) having a floor (12) and a surrounding wall (15), wherein the floor (12) and the surrounding wall (15) define a mold cavity (20); providing a first continuous phase isocyanate-terminated urethane prepolymer having 8 to 12 wt % unreacted NCO groups, a first continuous phase curative and, optionally, a plurality of hollow core polymeric materials; mixing the first continuous phase isocyanate-terminated urethane prepolymer and the first continuous phase curative to form a mixture; pouring the mixture into the mold cavity (20); allowing the mixture to solidify into a cake of the first continuous non-fugitive polymeric phase; deriving a sheet from the cake (preferably, deriving a plurality of sheets from the cake); forming the plurality of periodic recesses in the sheet to provide the first polishing layer component (preferably, forming the plurality of periodic recesses in the plurality of sheets to provide a plurality of first polishing layer components). More preferably, the plurality of hollow core polymeric materials is incorporated in the first continuous non-fugitive polymeric phase at 1 to 58 vol %. (See FIG. 1).

Preferably, in the method of the present invention, the mold cavity (20) has a central axis, $C_{axis}$, (22) that coincides with the z-axis and that intersects the horizontal internal boundary (14) of the floor (12) of the mold (10) at a center point (21). Preferably, the center point (21) is located at the geometric center of the cross section, $C_{x\text{-}sect}$, (24) of the mold cavity (20) projected onto the x-y plane (28). (See FIG. 1).

Preferably, the mold cavity's cross section, $C_{x\text{-}sect}$, (24) projected onto the x-y plane (28) can be any regular or irregular two dimensional shape. Preferably, the mold cavity's cross section, $C_{x\text{-}sect}$, (24) is selected from a polygon and an ellipse. More preferably, the mold cavity's cross section, $C_{x\text{-}sect}$, (24) is a substantially circular cross section having an average radius, $r_c$, (preferably, wherein $r_c$ is 20 to 100 cm; more preferably, wherein $r_c$ is 25 to 65 cm; most preferably, wherein $r_c$ is 40 to 60 cm). Most preferably, the mold cavity (20) approximates a right cylindrically shaped region having a substantially circular cross section, $C_{x\text{-}sect}$; wherein the mold cavity has an axis of symmetry, $C_{x\text{-}sym}$, (25) which coincides with the mold cavity's central axis, $C_{axis}$, (22); wherein the right cylindrically shaped region has a cross sectional area, $C_{x\text{-}area}$, defined as follows:

$$C_{x\text{-}area}=\pi r_c^2,$$

wherein $r_c$ is the average radius of the mold cavity's cross sectional area, $C_{x\text{-}area}$, projected onto the x-y plane (28); and wherein $r_c$ is 20 to 100 cm (more preferably, 25 to 65 cm; most preferably, 40 to 60 cm). (See FIG. 1).

Preferably, the chemical mechanical polishing pad composite polishing layer prepared using the method of the present invention can be interfaced with at least one additional layer to form a chemical mechanical polishing pad. Preferably, the chemical mechanical polishing pad composite polishing layer prepared using the method of the present invention is interfaced with a subpad (220) using a stack adhesive (210). Preferably, the subpad (220) is made of a material selected from the group consisting of an open cell foam, a closed cell foam, a woven material, a nonwoven material (e.g., felted, spun bonded, and needle punched materials), and combinations thereof. One of ordinary skill in the art will know to select an appropriate material of construction and subpad thickness, $T_s$, for use as a subpad (220). Preferably, the subpad (220) has an average subpad thickness, $T_{s\text{-}avg}$, of ≥15 mils (more preferably, 30 to 100 mils; most preferably 30 to 75 mils). (See FIG. 11).

One of ordinary skill in the art will know how to select an appropriate stack adhesive for use in the chemical mechanical polishing pad. Preferably, the stack adhesive is a hot melt adhesive. More preferably, the stack adhesive is a reactive hot melt adhesive. Still more preferably, the hot melt adhesive is a cured reactive hot melt adhesive that exhibits a melting temperature in its uncured state of 50 to 150° C., preferably of 115 to 135° C. and exhibits a pot life of ≤90 minutes after melting. Most preferably, the reactive hot melt adhesive in its uncured state comprises a polyurethane resin (e.g., Mor-Melt™ R5003 available from The Dow Chemical Company).

Preferably, the chemical mechanical polishing pad of the present invention is adapted to be interfaced with a platen of a polishing machine. Preferably, the chemical mechanical polishing pad is adapted to be affixed to the platen of a polishing machine. More preferably, the chemical mechanical polishing pad can be affixed to the platen using at least one of a pressure sensitive adhesive and vacuum.

Preferably, the chemical mechanical polishing pad (200) includes a pressure sensitive platen adhesive (230) applied to the subpad (220). One of ordinary skill in the art will know how to select an appropriate pressure sensitive adhesive for use as the pressure sensitive platen adhesive. Preferably, the chemical mechanical polishing pad will also include a release liner (240) applied over the pressure sensitive platen adhesive (230), wherein the pressure sensitive platen adhesive (230) is interposed between the subpad (220) and the release liner (240). (See FIG. 11).

An important step in substrate polishing operations is determining an endpoint to the process. One popular in situ method for endpoint detection involves providing a polishing pad with a window, which is transparent to select wavelengths of light. During polishing, a light beam is directed through the window to the wafer surface, where it reflects and passes back through the window to a detector (e.g., a spectrophotometer). Based on the return signal, properties of the substrate surface (e.g., the thickness of films thereon) can be determined for endpoint detection. To facilitate such light based endpoint methods, the chemical mechanical polishing pad (200) of the present invention, optionally further comprises an endpoint detection window (270). Preferably, the endpoint detection window is selected from an integral window incorporated into the composite polishing layer; and, a plug in place endpoint detection window block incorporated into the chemical mechanical polishing pad. One of ordinary skill in the art will know to select an appropriate material of construction for the end-point detection window for use in the intended polishing process. (See FIG. 14).

Some embodiments of the present invention will now be described in detail in the following Examples.

Examples 1-3: Chemical Mechanical Polishing Pads

Commercial polyurethane polishing pads were used as the first continuous non-fugitive polymeric phase in the chemical mechanical polishing pads prepared according to each of Examples 1-3. Particularly, in Example 1, a commercial IC1000™ polyurethane polishing pad with a plurality of concentric circular periodic recesses having an average recess depth, $D_{avg}$, of 30 mils, a width of 60 mils and a pitch of 120 mils was provided as the first continuous non-fugitive polymeric phase. In Example 2, a commercial VP5000™ polyurethane polishing pad with a plurality of concentric circular recesses having an average recess depth, $D_{avg}$, of 30 mils, a width of 35 mils and a pitch of 70 mils was provided as the first continuous non-fugitive polymeric phase. In Example 3, a commercial VP5000™ polyurethane polishing pad with a plurality of concentric circular recesses having an average recess depth, $D_{avg}$, of 30 mils, a width of 60 mils and a pitch of 120 mils was provided as the first continuous non-fugitive polymeric phase.

A poly side (P) liquid component was provided, containing: 77.62 wt % high molecular weight polyether polyol (Voralux® HF 505 polyol available from The Dow Chemical Company); 21.0 wt % monoethylene glycol; 1.23 wt % of a silicone surfactant (Tegostab® B8418 surfactant available from Evonik); 0.05 wt % of a tin catalyst (Fomrez® UL-28 available from Momentive); and, 0.10 wt % of a tertiary amine catalyst (Dabco® 33LV catalyst available from Air Products, Inc.). An additional liquid material (Specflex™ NR 556 $CO_2$/aliphatic amine adduct available from The Dow Chemical Company) was added to the poly side (P) liquid component at 4 parts per 100 parts poly side (P) liquid component by weight. An iso side (I) liquid component was provided, containing: 100 wt % of a modified diphenylmethane diisocyanate (Isonate™ 181 MDI prepolymer available from The Dow Chemical Company.) A pressurized gas (dry air) was provided.

A second non-fugitive polymeric phase was then provided in the plurality of concentric circular recesses of each of the first continuous non-fugitive polymeric phase materials using an axial mixing device (MicroLine 45 CSM axial mixing device available from Hennecke GmbH) having a (P) side liquid feed port, an (I) side liquid feed port and four tangential pressurized gas feed ports. The poly side (P) liquid component and the iso side (I) liquid component were fed to the axial mixing device through their respective feed ports with a (P) side charge pressure of 12,500 kPa, an (I) side charge pressure of 17,200 kPa and at a weight ratio of (I)/(P) of 1.564 (giving a stoichiometric ratio of reactive hydrogen groups to NCO groups of 0.95). The pressurized gas was fed through the tangential pressurized gas feed ports with a supply pressure of 830 kPa to give a combined liquid component to gas mass flow rate ratio through the axial mixing device of 3.8 to 1 to form a combination. The combination was then discharged from the axial mixing device toward each of the noted first continuous non-fugitive polymeric phases at a velocity of 254 m/sec to fill the plurality of recesses and forming composite structures. The composite structures were allowed to cure for 16 hours at 100° C. The composite structures were then machined flat on a lathe to derive the chemical mechanical polishing pads of Examples 1-3. The polishing surfaces of each of the chemical mechanical polishing pads of Examples 1-3, were then grooved to provide an X-Y groove pattern having a 70 mil groove width, 32 mil groove depth, and a 580 mil pitch.

Open Cell Porosity

The open cell porosity of commercial IC1000™ polishing pad polishing layers and VP5000™ polishing pad polishing layers is reported to be <3 vol %. The open cell porosity of the second non-fugitive polymeric phase formed in the chemical mechanical polishing pads in each of Examples 1-3 was >10 vol %.

Comparative Examples PC1-PC2 and Examples P1-P3

Chemical Mechanical Polishing Removal Rate Experiments

Silicon dioxide removal rate polishing tests were performed using the chemical mechanical polishing pads prepared according to each of Examples 1-3 and compared with those obtained in Comparative Examples PC1-PC2 using an IC1000™ polyurethane polishing pad and a VP5000™ (both commercially available from Rohm and Haas Electronic Materials CMP Inc.) and each having the same X-Y groove pattern noted in the Examples. Specifically, the silicon dioxide removal rate for each of the polishing pads is provided in TABLE 3. The polishing removal rate experiments were performed on 200 mm blanket S15KTEN TEOS sheet wafers from Novellus Systems, Inc. An Applied Materials 200 mm Mirra® polisher was used. All polishing experiments were performed with a down force of 8.3 kPa (1.2 psi), a slurry flow rate of 200 ml/min (ACuPlane™ 5105 slurry available from Rohm and Haas Electronic Materials CMP Inc.), a table rotation speed of 93 rpm and a carrier rotation speed of 87 rpm. A Saesol 8031C diamond pad conditioner (commercially available from Saesol Diamond Ind. Co., Ltd.) was used to condition the polishing pads. The polishing pads were each broken in with the conditioner using a down force of 31.1 N for 10 minutes. The polishing pads were further conditioned 50% in situ during polishing at 10 sweeps/min from 1.7 to 9.2 in from the center of the polishing pad with a down force of 31.1 N. The removal rates were determined by measuring the film thickness before and after polishing using a KLA-Tencor FX200 metrology tool using a 49 point spiral scan with a 3 mm edge exclusion. Each of the removal rate experiments were performed three times. The average removal rate for the triplicate removal rate experiments for each of the polishing pads is provided in TABLE 3.

TABLE 3

| Ex # | Chemical mechanical polishing pad | TEOS removal rate (Å/min) |
|---|---|---|
| PC1 | IC1000 ™ pad | 321 |
| PC2 | VP5000 ™ pad | 199 |
| P1 | Ex. 1 (1521A) | 426 |
| P2 | Ex. 2 (1521B) | 355 |
| P3 | Ex. 3 (1521C) | 304 |

We claim:

1. A method of forming a chemical mechanical polishing pad composite polishing layer, comprising:

providing a first polishing layer component of the chemical mechanical polishing pad composite polishing layer;

wherein the first polishing layer component has a polishing side, a base surface, a plurality of periodic recesses and an average first component thickness, $T_{1\text{-}avg}$, measured normal to the polishing side from the base surface to the polishing side;

wherein the first polishing layer component comprises a first continuous non-fugitive polymeric phase;

wherein the plurality of periodic recesses have an average recess depth, $D_{avg}$, measured normal to the polishing side from the polishing side toward the base surface, wherein the average recess depth, $D_{avg}$, is less than the average first component thickness, $T_{1\text{-}avg}$;

wherein the first continuous non-fugitive polymeric phase is a reaction product of a first continuous phase isocyanate-terminated urethane prepolymer having 8 to 12 wt % unreacted NCO groups and a first continuous phase curative;

providing a poly side (P) liquid component, comprising at least one of a (P) side polyol, a (P) side polyamine and a (P) side alcohol amine;

providing an iso side (I) liquid component, comprising at least one polyfunctional isocyanate;

providing a pressurized gas;

providing an axial mixing device having an internal cylindrical chamber;

wherein the internal cylindrical chamber has a closed end, an open end, an axis of symmetry, at least one (P) side liquid feed port that opens into the internal cylindrical chamber, at least one (I) side liquid feed port that opens into the internal cylindrical chamber, and at least one tangential pressurized gas feed port that opens into the internal cylindrical chamber;

wherein the closed end and the open end are perpendicular to the axis of symmetry;

wherein the at least one (P) side liquid feed port and the at least one (I) side liquid feed port are arranged along a circumference of the internal cylindrical chamber proximate the closed end;

wherein the at least one tangential pressurized gas feed port is arranged along the circumference of the internal cylindrical chamber downstream of the at least one (P) side liquid feed port and the at least one (I) side liquid feed port from the closed end;

wherein the poly side (P) liquid component is introduced into the internal cylindrical chamber through the at least one (P) side liquid feed port at a (P) side charge pressure of 6,895 to 27,600 kPa;

wherein the iso side (I) liquid component is introduced into the internal cylindrical chamber through the at least one (I) side liquid feed port at an (I) side charge pressure of 6,895 to 27,600 kPa;

wherein a combined mass flow rate of the poly side (P) liquid component and the iso side (I) liquid component to the internal cylindrical chamber is 1 to 500 g/s;

wherein the poly side (P) liquid component, the iso side (I) liquid component and the pressurized gas are intermixed within the internal cylindrical chamber to form a combination;

wherein the pressurized gas is introduced into the internal cylindrical chamber through the at least one tangential pressurized gas feed port with a supply pressure of 150 to 1,500 kPa;

wherein an inlet velocity into the internal cylindrical chamber of the pressurized gas is 50 to 600 m/s calculated based on ideal gas conditions at 20° C. and 1 atm pressure;

discharging the combination from the open end of the internal cylindrical chamber toward the polishing side of the first polishing layer component at a velocity of 5 to 1,000 m/sec, filling the plurality of periodic recesses with the combination;

allowing the combination to solidify as a second polishing layer component in the plurality of periodic recesses to form a composite structure; wherein the second polishing layer component is a second non-fugitive polymeric phase; and, deriving the chemical mechanical polishing pad composite polishing layer from the composite structure, wherein the chemical mechanical polishing pad composite polishing layer has a polishing surface on the polishing side of the first polishing layer component; and wherein the polishing surface is adapted for polishing a substrate.

2. The method of claim 1, further comprising:

machining the composite structure to derive the chemical mechanical polishing pad composite polishing layer;

wherein the chemical mechanical polishing pad composite polishing layer so derived has an average composite polishing layer thickness, $T_{P\text{-}avg}$, measured normal to the polishing surface from the base surface to the polishing surface;

wherein the average first component thickness, $T_{1\text{-}avg}$, equals the average composite polishing layer thickness, $T_{P\text{-}avg}$;

wherein the second non-fugitive polymeric phase occupying the plurality of periodic recesses has an average height, $H_{avg}$, measured normal to the polishing surface from the base surface toward the polishing surface; and, wherein an absolute value of a difference, $\Delta S$, between the average composite polishing layer thickness, $T_{P\text{-}avg}$, and the average height, $H_{avg}$, is $\leq 0.5$ μm.

3. The method of claim 2, further comprising:

forming at least one groove in the polishing surface.

4. The method of claim 1, wherein providing the first polishing layer component, further comprises:

providing a mold having a floor and a surrounding wall, wherein the floor and the surrounding wall define a mold cavity;

providing the first continuous phase isocyanate-terminated urethane prepolymer having 8 to 12 wt % unreacted NCO groups, the first continuous phase curative and, optionally, a plurality of hollow core polymeric materials;

mixing the first continuous phase isocyanate-terminated urethane prepolymer and the first continuous phase curative to form a mixture;

pouring the mixture into the mold cavity;

allowing the mixture to solidify into a cake of the first continuous non-fugitive polymeric phase;

deriving a sheet from the cake;

forming the plurality of periodic recesses in the sheet to provide the first polishing layer component.

5. The method of claim 4, wherein the plurality of hollow core polymeric materials is incorporated in the first continuous non-fugitive polymeric phase at 1 to 58 vol %.

6. The method of claim 1, wherein the poly side (P) liquid component comprises 25 to 95 wt % of a (P) side polyol; wherein the (P) side polyol is a high molecular weight polyether polyol; wherein the high molecular weight polyether polyol has a number average molecular weight, $M_N$, of 2,500 to 100,000 and an average of 4 to 8 hydroxyl groups per molecule.

7. The method of claim 1, wherein the iso side (I) liquid component comprises a polyfunctional isocyanate having an average of two reactive isocyanate groups per molecule.

8. The method of claim 1, wherein the pressurized gas is selected from the group consisting of: $CO_2$, $N_2$, air and argon.

9. The method of claim 1, wherein the internal cylindrical chamber has a circular cross section in a plane perpendicular to the axis of symmetry of the internal cylindrical chamber; wherein the open end of the internal cylindrical chamber has a circular opening perpendicular to the axis of symmetry of the internal cylindrical chamber; wherein the circular opening is concentric with the circular cross section; and, wherein the circular opening has an inner diameter of 2.5 to 6 mm.

10. The method of claim 1, wherein the polishing surface is adapted for polishing a semiconductor wafer.

* * * * *